US011801176B2

(12) United States Patent
Eriksson et al.

(10) Patent No.: US 11,801,176 B2
(45) Date of Patent: Oct. 31, 2023

(54) PATIENT STAND ASSIST DEVICES WITH FEATURES FOR GOVERNING THE ASSIST PATH

(71) Applicant: Liko Research & Development AB, Luleå (SE)

(72) Inventors: Anders Joakim Eriksson, Luleå (SE); Elin K. Dovervik, Luleå (SE); Gun Blom, Luleå (SE); Jack Barney Sing, Batesville, IN (US); Lars Eklof, Luleå (SE); Roger Karlsson, Rosvik (SE); Ronnie Arespong, Boden (SE)

(73) Assignee: Liko Research & Development AB, Lulea (SE)

( * ) Notice: Subject to any disclaimer, the term of this patent is extended or adjusted under 35 U.S.C. 154(b) by 474 days.

(21) Appl. No.: 17/100,053

(22) Filed: Nov. 20, 2020

(65) Prior Publication Data

US 2021/0137759 A1 May 13, 2021

Related U.S. Application Data

(60) Continuation of application No. 16/279,318, filed on Feb. 19, 2019, now Pat. No. 10,874,565, which is a (Continued)

(51) Int. Cl.
*A61G 5/14* (2006.01)
*A61G 7/10* (2006.01)

(52) U.S. Cl.
CPC ..... *A61G 5/14* (2013.01); *A61G 7/1017* (2013.01); *A61G 7/1046* (2013.01); (Continued)

(58) Field of Classification Search
CPC .. A61G 7/1046; A61G 7/1015; A61G 7/1017; A61G 7/1019; A61G 7/1051
See application file for complete search history.

(56) References Cited

U.S. PATENT DOCUMENTS 2,991,485 A 7/1961 Schulte
3,374,493 A 3/1968 Herrera
(Continued)

FOREIGN PATENT DOCUMENTS

CA 2302060 A1 9/2001
DE 19803130 A1 7/1998
(Continued)

OTHER PUBLICATIONS

Communication pursuanl lo Article 94(3) EPC dated Sep. 30, 2015; EP Application No. 12176211.6-1651; Applicant—Likc Research & Development AB; Ref.: P/68597.EP01AF; Fornalities Officer Klug Desiree; 8-pages.
(Continued)

*Primary Examiner* — Eric J Kurilla
(74) *Attorney, Agent, or Firm* — Dinsmore & Shohl LLP

(57) ABSTRACT

A patient assisting system includes a frame having a sling assembly attachment point and a lifting arm which is movable relative to the frame and which includes a receptacle. When the sling assembly is attached to the attachment point and extends through the receptacle, a portion of the sling travels through the receptacle as the lifting arm moves relative to the frame. Another embodiment includes exactly one four bar linkage comprised of a frame having an attachment point for a sling assembly, a lifting arm having a receptacle, a lower cross arm and an upper cross arm. The lifting arm is adapted to be movable between a person-seated position and a person-standing position. The receptacle is located along the lifting arm so that motion of the lifting arm causes the receptacle to move along a curved path having a concave side which is person-facing.

19 Claims, 21 Drawing Sheets

Related U.S. Application Data continuation of application No. 15/991,089, filed on May 29, 2018, now Pat. No. 10,251,796, which is a division of application No. 13/594,445, filed on Aug. 24, 2012, now Pat. No. 10,045,895.

(60) Provisional application No. 61/526,754, filed on Aug. 24, 2011.

(52) U.S. Cl.
CPC ..... *A61G 7/1051* (2013.01); *A61G 7/1094* (2013.01); *A61G 7/1065* (2013.01); *A61G 7/1096* (2013.01); *A61G 7/1098* (2013.01); *A61G 2200/34* (2013.01); *A61G 2200/36* (2013.01); *A61G 2203/12* (2013.01); *A61G 2203/16* (2013.01); *A61G 2203/20* (2013.01); *A61G 2203/32* (2013.01); *A61G 2203/44* (2013.01)

(56) References Cited

U.S. PATENT DOCUMENTS

| | | | |
|---|---|---|---|
| 4,884,841 | A | 12/1989 | Holley |
| 4,985,947 | A | 1/1991 | Ethridge |
| 5,117,516 | A | 6/1992 | Penner |
| 5,185,895 | A | 2/1993 | Gagne et al. |
| 5,273,502 | A | 12/1993 | Kelsey et al. |
| 5,309,584 | A | 5/1994 | Parker |
| 5,365,621 | A | 11/1994 | Blain |
| 5,411,044 | A | 5/1995 | Andolfi |
| 5,459,891 | A | 10/1995 | Reeve et al. |
| 5,502,851 | A | 4/1996 | Costello |
| 5,644,805 | A | 7/1997 | Horcher |
| 5,878,450 | A | 3/1999 | Bouhuijs |
| 5,892,180 | A | 4/1999 | Carey |
| 5,953,774 | A | 9/1999 | Arndt |
| 6,092,247 | A | 7/2000 | Wilson |
| 6,273,844 | B1 | 8/2001 | Kelsey et al. |
| 6,289,534 | B1 | 9/2001 | Hakamiun et al. |
| 6,389,619 | B1 | 5/2002 | Dunn |
| 6,449,785 | B1 | 9/2002 | Iljedahl |
| 6,507,961 | B1 | 1/2003 | Ming-Hwa |
| 6,578,594 | B1 | 6/2003 | Bowen et al. |
| 6,581,222 | B1 | 6/2003 | Liljedahl |
| 6,679,510 | B2 | 1/2004 | Perena |
| 6,806,430 | B2 | 10/2004 | Downing |
| 6,821,233 | B1 | 11/2004 | Colombo et al. |
| 6,904,801 | B1 | 6/2005 | Bridges et al. |
| 6,935,353 | B2 | 8/2005 | Hawkes et al. |
| 6,959,940 | B2 | 11/2005 | Perena |
| 7,356,858 | B2 | 4/2008 | Summers |
| 7,434,278 | B2 | 10/2008 | White et al. |
| 7,540,045 | B2 | 6/2009 | Nativ |
| 7,647,237 | B2 | 1/2010 | Malave et al. |
| 7,883,450 | B2 | 2/2011 | Hidler |
| 8,607,378 | B2 | 12/2013 | Moriarity et al. |
| 11,638,669 | B2 * | 5/2023 | Liljedahl ..... B66C 23/62 254/120 |
| 2002/0065173 | A1 | 5/2002 | Cook |
| 2005/0268397 | A1 | 12/2005 | Nativ |
| 2006/0048294 | A1 | 3/2006 | Maguire et al. |
| 2006/0048297 | A1 | 3/2006 | Mills |
| 2008/0183493 | A1 | 7/2008 | Bogue |
| 2009/0165203 | A1 | 7/2009 | Biersteker et al. |
| 2009/0165204 | A1 | 7/2009 | Biersteker et al. |
| 2009/0165207 | A1 | 7/2009 | Reed et al. |
| 2009/0174680 | A1 | 7/2009 | Anzures et al. |
| 2010/0031439 | A1 | 2/2010 | Spidare et al. |
| 2010/0154117 | A1 | 6/2010 | Odashima et al. |
| 2010/0224841 | A1 | 9/2010 | Liljedahl |
| 2010/0234196 | A1 | 9/2010 | Shinomiya et al. |
| 2011/0043062 | A1 | 2/2011 | Lorenzen |
| 2011/0056019 | A1 | 3/2011 | Altena et al. |
| 2011/0277236 | A1 | 11/2011 | Moriarity et al. |
| 2012/0255118 | A1 | 10/2012 | Hammond et al. |
| 2013/0221716 | A1 | 8/2013 | Purwar et al. |
| 2013/0263374 | A1 | 10/2013 | Yamaguchi et al. |
| 2013/0319775 | A1 | 12/2013 | Ngoh et al. |
| 2014/0013503 | A1 | 1/2014 | Dixon et al. |

FOREIGN PATENT DOCUMENTS

| | | | |
|---|---|---|---|
| EP | 1029524 | A2 | 8/2000 |
| EP | 1088539 | A1 | 4/2001 |
| EP | 1449808 | A1 | 8/2004 |
| EP | 1772132 | A1 | 4/2007 |
| GB | 2140773 | B | 8/1986 |
| GB | 2296901 | A | 7/1996 |
| GB | 2427057 | B | 10/2007 |
| NL | 9301145 | A | 1/1995 |
| WO | 1995018592 | A1 | 7/1995 |
| WO | 199628125 | A1 | 9/1996 |
| WO | 1996028125 | A1 | 9/1996 |
| WO | 2005053593 | A1 | 6/2005 |
| WO | 2006109050 | A2 | 10/2006 |
| WO | 200708147 | A1 | 1/2007 |
| WO | 2009136359 | A1 | 11/2009 |
| WO | 2010017438 | A2 | 2/2010 |
| WO | 2010084421 | A2 | 7/2010 |
| WO | 2010085332 | A2 | 7/2010 |
| WO | 2010141865 | A2 | 12/2010 |
| WO | 2011002312 | A1 | 1/2011 |
| WO | 2011097698 | A1 | 8/2011 |

OTHER PUBLICATIONS

Communication Search Report dated Jun. 12, 2016 EP Application No. 12176211.6-1651; Reference P/68597_EP02; Pursuant to Rule 69 EPC 1-page.

European Search Report for EP Application No. 12176211; Place of search—The Hague; Dale of completion of the search—dated Nov. 30, 2012; 4-pages.

Arjohuntleigh; Maxi Move—A mobile passive lifter for demanding care environments; Brochure; Printed in the Czech Republic; Dec. 2008.

Fundamental of Design topic 4 Linkages; (C)2008 Alexander Slocum; Jan. 1, 2008; 62 pages.

International Search Report EP Application No. PCT/U82012/052235; International filing date—Aug. 24, 2012; Date of the actual completion of the International Search—Dec. 27, 2012; dated Jan. 10, 2013; Authorized Officer—Blaine R. Copenheaver.

Written Opinion of the International Search Authority; International Application No. PCT/US2012/052235 International filing Date—Aug. 24, 2012; Date of completion of this opinion—Dec. 27, 2012; dated Jan. 10, 2013; Authorized Officer—Blaine R. Copenhearver.

Communication Search Report dated Jun. 12, 2016 to Application No. 16185301.5-1651 Reference P/68597.EP02; Applicant Liko Research & Development AB; Place of search The Hague; Date of completion of the search Nov. 28, 2016; 5 pages.

* cited by examiner

PATIENT STAND ASSIST DEVICES WITH FEATURES FOR GOVERNING THE ASSIST PATH

CROSS-REFERENCE TO RELATED APPLICATIONS

This application is a continuation of U.S. application Ser. No. 16/279,318, filed Feb. 19, 2019, and entitled "Patient Stand Assist and Therapy Devices and Methods", which is a continuation of U.S. application Ser. No. 15/991,089 (now U.S. Pat. No. 10,251,796) filed on May 29, 2018 and entitled "Patient Stand Assist and Therapy Devices and Methods", which is a Divisional of U.S. Ser. No. 13/594,445 (now U.S. Pat. No. 10,045,895) filed on Aug. 24, 2012 and also entitled "Patient Stand Assist and Therapy Devices and Methods" and which claims priority to U.S. Provisional Application Ser. No. 61/526,754, filed on Aug. 24, 2011, the contents of all of which are incorporated herein by reference.

BACKGROUND OF THE DISCLOSURE

Patient stand assist or "sit-to-stand" devices are known. Often, such devices require little or no muscular assistance from the patient to get the patient to a standing position. Also, such devices typically provide no indication of the wellness or progress of the patient. In addition, such devices often do little to strengthen the patient during the movement to the standing position. Moreover, such devices can move the patient through suboptimal motions.

While various stand assist devices are known, a need persists in enhancing the features and functionality of such devices, and overcoming one or more problems or inconveniences associated with such devices.

SUMMARY

The present disclosure comprises one or more of the features recited in the appended claims and/or the following features which, alone or in any combination, may comprise patentable subject matter.

In one contemplated embodiment, a system for assisting a person comprises a frame, a guide, a lift arm and a sling. The guide is rotatably coupled to the frame at a first joint. The guide includes a slot there through. The actuator is rotatably coupled to the frame at a second joint. The lift arm is rotatably coupled to the actuator at a third joint and a free end of the lift arm being movable within the slot. The lift arm is configured to cause the guide to rotate about the first joint with respect to the frame as the actuator moves the lift arm between a first position and a second position with respect to the frame. The sling is configured to engage a person and assist a person in moving between a seated position and a standing position as the lift arm moves between the first position and the second position.

In another contemplated embodiment, a system for assisting a person comprises a frame, a lift arm rotatably coupled to the frame, a sling, and an actuation assembly. The sling is configured to be coupled to a person and include at least one strap. The at least one strap is removably coupled to the frame and configured to movably engage the lift arm. The actuation assembly is configured to move the lift arm with respect to the frame to cause the sling to move from a first position to a second position to assist a person in moving between a seated position and a standing position.

In another contemplated embodiment, a system for assisting a patient comprises a frame, a sling support assembly rotatably coupled to the frame, an actuator rotatably coupled to the frame, and a four bar mechanism. The four bar mechanism is rotatably coupled to the frame, the actuator, and the sling support assembly. The four bar mechanism is configured to be moved by the actuator to cause the sling support to rotate with respect to the frame between a first position and a second position to assist a person in moving between a seated position and a standing position along a generally concave, elliptical path.

In another contemplated embodiment, a system for assisting a patient comprises a sling including a strap, a fixed frame having a main pillar and attachment points for an end of the strap, and a moving member movably coupled to the fixed frame. The moving member has receptacles configured to receive the strap of the sling and to allow the strap to slide along the receptacles as the moving member moves relative to the fixed frame to cause the sling to move upwardly and inwardly relative to the pillar.

In another contemplated embodiment, a person lift system comprises a person lifting mechanism, a harness, an actuator, and a display. The person lifting mechanism includes a frame and a person lifting interface movable with respect to the frame. The harness is configured to be coupled to a person and coupled to the person lifting interface. The actuator is coupled to the frame and configured to move the person lifting interface with respect to the frame to move the harness from a first position to a second position with respect to the frame. The display is coupled to the lifting mechanism and configured to display a person's rehabilitation progress.

In another contemplated embodiment, a method for monitoring a patient's strength using a person lift device comprises: receiving the patient's weight; monitoring the actual force used to lift the patient using the lifting device; determining the patient's strength by using the actual force and an expected force which is based on the patient's weight; providing an indication of the patient's strength based on the comparison.

In another contemplated embodiment, a method for monitoring a patient's strength using a sit-to-stand device comprises: monitoring a first force used to lift the patient using a lifting device at a first time; monitoring a second force used to lift the patient using the lifting device at a second time; determining a change in the patient's strength based on the first and second actual forces; providing an indication of the patient's strength improvement based on the determination.

In another contemplated embodiment, a patient lifting device comprises a lifting actuator and an electronics unit. The electronics unit is configured to receive the patient's weight and determine the patient's strength based upon the patient's weight and the amount of energy required to lift the patient using the lifting actuator.

In another contemplated embodiment, a patient lifting device comprises a lifting actuator and an electronics unit. The electronics unit is configured to determine a change in the patient's strength based upon the amount of energy required to lift the patient using the lifting actuator at a first period of time and at a second period of time.

In another contemplated embodiment, a patient lifting device comprises a lifting actuator and an electronics unit. The electronics unit is configured to determine a change in the patient's strength based upon the amount of energy required to lift the patient using the lifting actuator at a first period of time and at a second period of time. The electronics unit controls the lifting actuator at a third period of time as a function of the change in the patient's strength.

In another contemplated embodiment, a display apparatus comprises an area to display a prior amount of effort required for a person to move between a substantially seated position and a substantially standing position using a device configured to assist the person in moving from a seated position to a standing position, and an area to display a current amount of effort required by the person to move from a substantially seated position to a substantially standing position.

In another contemplated embodiment, a system for assisting a patient comprises a sling, a fixed frame, a lift arm, an actuator, and a controller. The sling is adapted to go around the back of a patient and comprising straps adapted to go under the patient's arms. The lift arm is supported by the frame and movable relative to the fixed frame and includes a portion for supporting the sling. The actuator moves the arm. Initial movement of the arm by the actuator causes the patient's torso to initially move forward and generally over the thighs while the patient is in an initial sitting position. Further movement of the arm causes the patient to be pulled upwardly to a standing position. The controller is configured to control the actuator as a function of an amount of assistance needed to move the patient to the standing position. The amount of assistance changes over time based on the patient's strength.

In another contemplated embodiment, a method for assisting a patient carried out by a patient assist device comprises: moving a patient assist device in a way which is adapted to move the patient's torso generally over the thighs and tilted forward while the patient is in an seated position; simultaneously or subsequently moving the device in a way which is adapted to raise the patient's torso generally upwardly toward a generally standing position; and varying the amount of assistance provided by the patient assist device to at least one of move the patient's torso generally over the thighs and tilted forward and simultaneously or subsequently move the patient's torso generally upwardly as a function of the patient's strength.

In another contemplated embodiment, a system for assisting a person comprises a frame, a lift member movably coupled to the frame, a sling coupled to the lift member and configured to engage a person, an actuating device coupled to the frame and the lift member, a sensor configured to sense at least one characteristic of the actuating device, and a controller. The actuating device is configured to move the lift member with respect to the frame to move a person engaged by the sling from a first position to a second position. The controller is electrically coupled to the sensor and configured to determine an amount of strength of the person engaged by the lifting device as a function of the at least one characteristic of the actuating device as a person is moved from the first position to the second position.

In another contemplated embodiment, a patient lifting device comprises a lifting actuator and an electronics unit. The electronics unit is configured to receive the patient's weight and determine the patient's strength based upon the patient's weight and the amount of force output by the lifting actuator to lift the patient. The amount of force is measured by a sensor coupled to the actuator.

In another contemplated embodiment, a method of increasing the strength of a person using a person lift device comprises: determining a first amount of assistance used to move a person from a first position to a second position; comparing the first amount of assistance to a previously determined amount of assistance; and providing a second amount of assistance as a function of the first amount of assistance and the previously determined amount of assistance.

BRIEF DESCRIPTION OF THE DRAWINGS

The detailed description refers to the accompanying figures showing illustrative embodiments or examples, in which.

DETAILED DESCRIPTION OF ILLUSTRATIVE EMBODIMENTS

The present disclosure relates to patient lifting devices and methods. One embodiment is a patient sit-to-stand device which moves the patient through an improved sequence of movements. In one embodiment, a sit-to-stand device moves the patient's torso forward first, such that the torso is generally tilted forward and over the thighs. The device then lifts the patient. In another embodiment, a patient lifting device includes an electronics unit which carries out a method or algorithm to determine the patient's strength and/or the change in the patient's strength. The method comprises determining patient progress and/or strength based on the force (e.g., energy) required to lift the patient, and/or the expected force required to lift the patient using patient weight. Still other embodiments can include any one or more of the following features, alone or in any combination: 1) a system configured to move the torso forward while the patient is in a seated position such that the torso is generally tilted forward and over the thighs, and to then lift the patient to the standing position; 2) a four bar mechanism which creates an initial movement which causes forward movement of the sling support, and later movement which causes backward movement of the sling support; 3) a sit-to-stand lift arm which moves rotationally while simultaneously allowing the lift arm to slide within a slot; 4) a sling which has straps which goes under the arms of the patient and around the back of the patient and is pulled by a lift arm which moves in a nonlinear manner to pull the patient's torso forward first and then upward; 5) a sit-to-stand lift arm system which comprises multiple segments and multiple pivot points and is configured to cause the sling support to initially move in a direction having a forward component and then to move in a direction having a backward component; 6) a four bar mechanism for a sit-to-stand system which is moved by an actuator to cause a sling support to be moved forwardly and upwardly; 7) a system having a fixed frame with fixed attachment points for a sling and a moving member movable relative to the fixed frame and having sliding attachment points for the sling to cause the sling to move upwardly and inwardly; 8) a system having a fixed frame and an arm which has a patient sling support and is simultaneously rotatable relative to the fixed frame and slides within an aperture of the fixed frame; 9) a device and method for determining patient strength by using the actual electrical energy required to lift the patient using a lifting device and the expected electrical energy required to lift the patient (as indicated by patient weight); and/or 10) a device and method for determining improvement in patient strength by using the actual electrical energy required to lift the patient using a lifting device at two different times.

Figure 3:
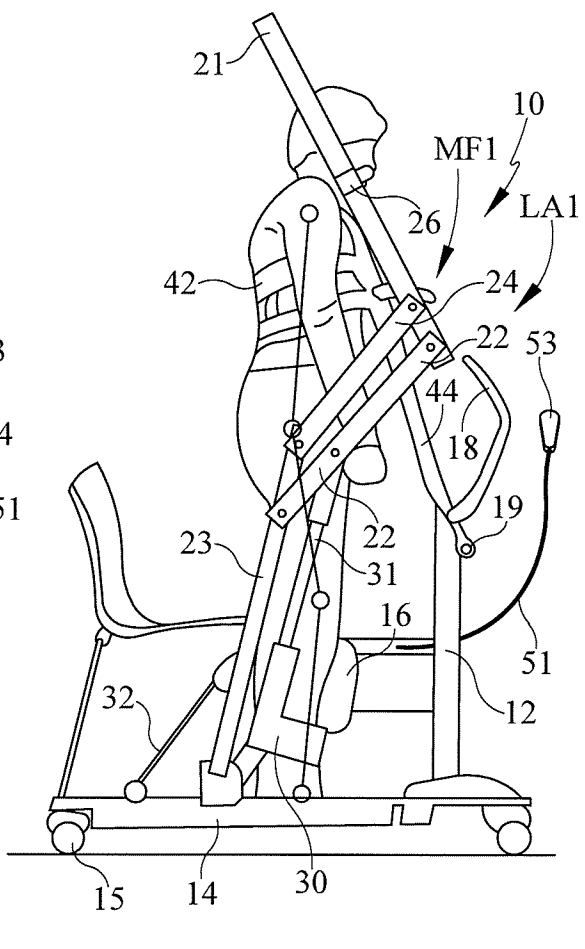
FIG. 3 is side view of the embodiment of FIG. 1, shown in the raised/standing position, wherein the sling support has moved further upward but also has moved backward.
Figure 2:
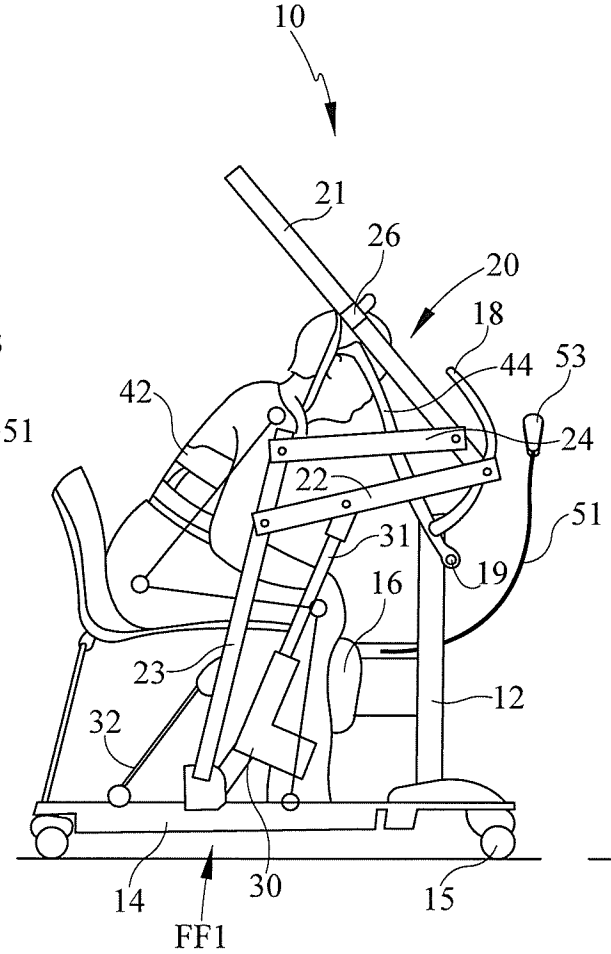
FIG. 2 is a side view of the embodiment of FIG. 1, shown in the intermediate/forward position prior to lifting, wherein the sling support has moved forward and upward.
Figure 1:
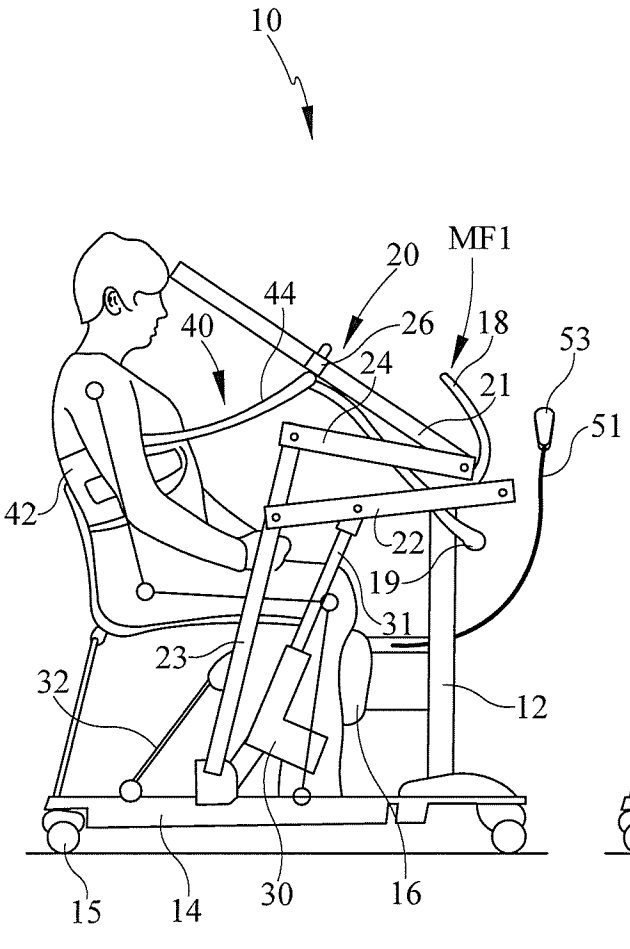
FIG. 1 is a side view of a sit-to-stand system according to one example embodiment, shown in the initial lowered/sitting position, and configured and operating according to one or more inventive principles.

Turning now to the drawings, wherein the same or similar numerals (e.g., 52, 52' and 152) indicate the same or similar elements throughout the views, FIGS. 1-3 are side views of a sit-to-stand system 10 according to one example embodiment. These figures show the embodiment in the initial lowered/sitting position (FIG. 1), then in an intermediate/forward position (FIG. 2), and then in a raised/standing position (FIG. 3). In this embodiment, a lift assembly LA1 comprising a fixed frame FF1 and a moving frame MF1 and an actuation assembly that moves the moving frame MF1 with respect to the fixed frame FF1 is provided. The fixed frame FF1 comprises a main pillar 12, a lower frame 14, a shin pad 16, and handles 18. The lower frame 14 comprises a pair of feet stabilizing members, and wheels (e.g., casters) 15 can be coupled with the lower frame 14, for rolling the device to the desired location. The feet may be pivotably adjusted, pointing more inwardly or outwardly as desired. The shin pad 16 is provided for placing the patient's legs against, for stability, and is adjustable in height. Handles 18 are provided for grasping by the patient, for assistance or stability, and are also adjustable in height via telescoping members. Straps 44 of the patient sling 40 (e.g. a harness, vest, or belt) are fixedly attached to the fixed frame at connection 19.

The moving frame MF1 is movably coupled to the fixed frame FF1 and the actuation assembly. The moving frame MF1 includes a four bar mechanism 20, one on each side of the device 10. In this example, each mechanism 20 comprises a pair of upright arms 21/23, and a pair of cross arms 22/24 which each pivotably connect to each of the upright arms 21/23. The upright arm 23 is pivotably attached to the lower frame 14, but is secured in place by adjustment screw 32. The screw can be turned to adjust how much tilt is applied to the upright arm 23, but the arm 23 is otherwise held securely in place by the screw 32. Each four bar mechanism 20 includes a sling support 26 on the upright bar 21 which supports the patient sling/belt 40. In this example, the sling supports 26 hold the straps 44 of the sling 40 like a hook or hanger, such that the straps 44 may freely slide through the sling supports. The sling supports 26 may be integral or separate from the upright 21, but in this example are separate parts whose location along the upright bar can be adjusted, such as, by sliding and screwing the support into place. The sling supports may be in the form of hooks or receptacles, but can also be any other member which can engage or contact the strap. The actuation assembly includes a linear actuator motor 30 is pivotally attached to the lower cross arm 22 via its moving arm 31. The arm 31 causes the movement of the arms of the four bar mechanism 20 in the manner shown by FIGS. 1-3. In some embodiments, a pad is positioned on the straps 44 of the sling 40 for the patient to contact when the patient is in the intermediate position, i.e., leaning forward. Also, in some embodiments, a torso support can be coupled to the main pillar 12 or a portion of the four bar mechanism 20 to support the torso of the patient when the patient is in the intermediate position.

The placement and configuration of the arms 21-24, the actuator 30, the arm 31, the shin pads 16, and the sling support 26, in addition to the length of the straps 44, causes the movement of the belt portion 42, and subsequently the patient, as shown in FIGS. 1-3. The proportions and placements of these members as shown in these figures are examples of how to cause one desired motion, as shown. As best shown in FIG. 1, the seated patient's legs are placed against shin pad 16. The straps 44 are nearly fully extended in this position. As the actuator arm 31 is extended by the actuator 30, the arm 21 pulls on the strap 44 causing it to pull the belt portion 42 forward, as the sling support 26 moves forwardly and upwardly simultaneously (i.e., the motion imparted has a forward component and an upward component). The strap 44 slides over the support 26 during this motion since it is secured (e.g., by tying or hooking or clamping) at fixed connection 19. This causes the patient to lean forward with the torso generally over the thighs, and the head generally over the knees, as shown in the intermediate position of FIG. 2.

As the actuator arm 31 extends further, the support 26 continues to pull the straps 44 upwardly, but with little or no continued forward motion, causing the belt portion 42 to be pulled upwardly. This motion lifts the belt portion 42, causing the patient to rise from the seated position to the standing position, as shown by comparing FIG. 2 with FIG.

3. During this motion, the support 26 actually moves upwardly and backwardly (i.e., with a motion having both upward and backward components), arriving at the position shown in FIG. 3. This motion of the support 26 closely mimics the typical motion of a person's shoulder, when standing from the sitting position, under the person's own power, shown by the top dot in FIGS. 1-3 (particularly the initial significant forward component, and then upward component, with little or negative forward component following the initial movement). The up and down motions of the device are controlled by a user interface that controls the actuator 30, which in this example comprises a control pendant 53 connected to electronics that control the actuator via cord 51. The pendant 53 includes up/down buttons and other buttons to control the functions of the device.

Figure 4:
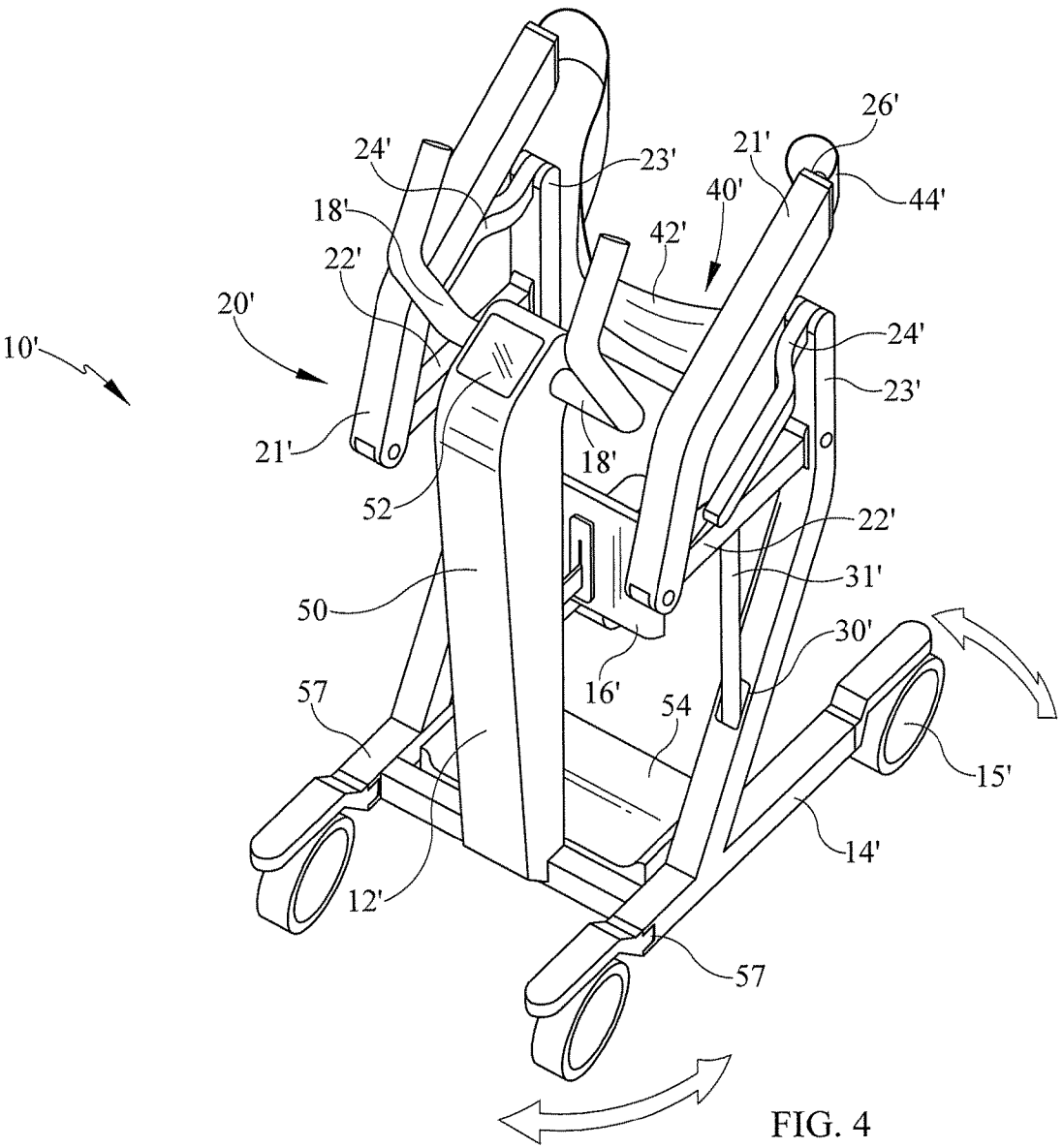
FIG. 4 is perspective view illustrating a second example embodiment of a sit-to-stand system which is configured and operating according to one or more the inventive principles.

FIG. 4 is perspective view illustrating a second example embodiment of a sit-to-stand system which is made and operating according to one or more the inventive principles. In this example, the functions and structures are similar to that of FIG. 1, with the following exceptions. The upright arm 23' tilts generally backwardly rather than forwardly, and the actuator 30 is enclosed in the arm 23'. Also, the actuator arm 31' extends between the upright arm 23' and the lower cross arm 22'. Additionally, the straps 44' enter the strap support 26' (in this example a receptacle in the arm 21'), slide over the surface defining the support 26', and are fixedly secured inside of the arm 21'. Additionally, a foot support in the form of platform 54 is secured to the lower frame 14, slightly above the floor, for the patient to place their feet and to stand upon. Moreover, an electronics system is provided within covered control box 50 on the main pillar 12', which includes electronics to run the user interface (which in this example is in the form of a touch sensitive screen 52) and control the movement of the actuators 30. Accordingly, the user can utilize the screen 52 to control the motions of the system 10'. In some contemplated embodiments, the user can access information on the device, receive feedback on the performance of the user or device, receive alerts, and/or can configure the operation of the device by way of the screen 52. In addition, the lower frame feet 14' are pivotably about pivot points 57 to allow the wheelbase to be adjusted.

Otherwise, the operation of the example of FIG. 4 is similar to that of FIG. 1. The patient sits in a chair and the caregiver moves the device 10' in front of the patient. The patient's feet are placed upon the platform 54 and the knees are placed against the pads 16'. The belt 42' is placed around the patient's waist. The screen 52 is used to raise the patient, first in a forward motion as the arms 21' pull the straps 44' inwardly and upwardly under the patient's arms, and then in an upward motion as the arms 21' continue to pull in a more upward motion.

Figure 19A:
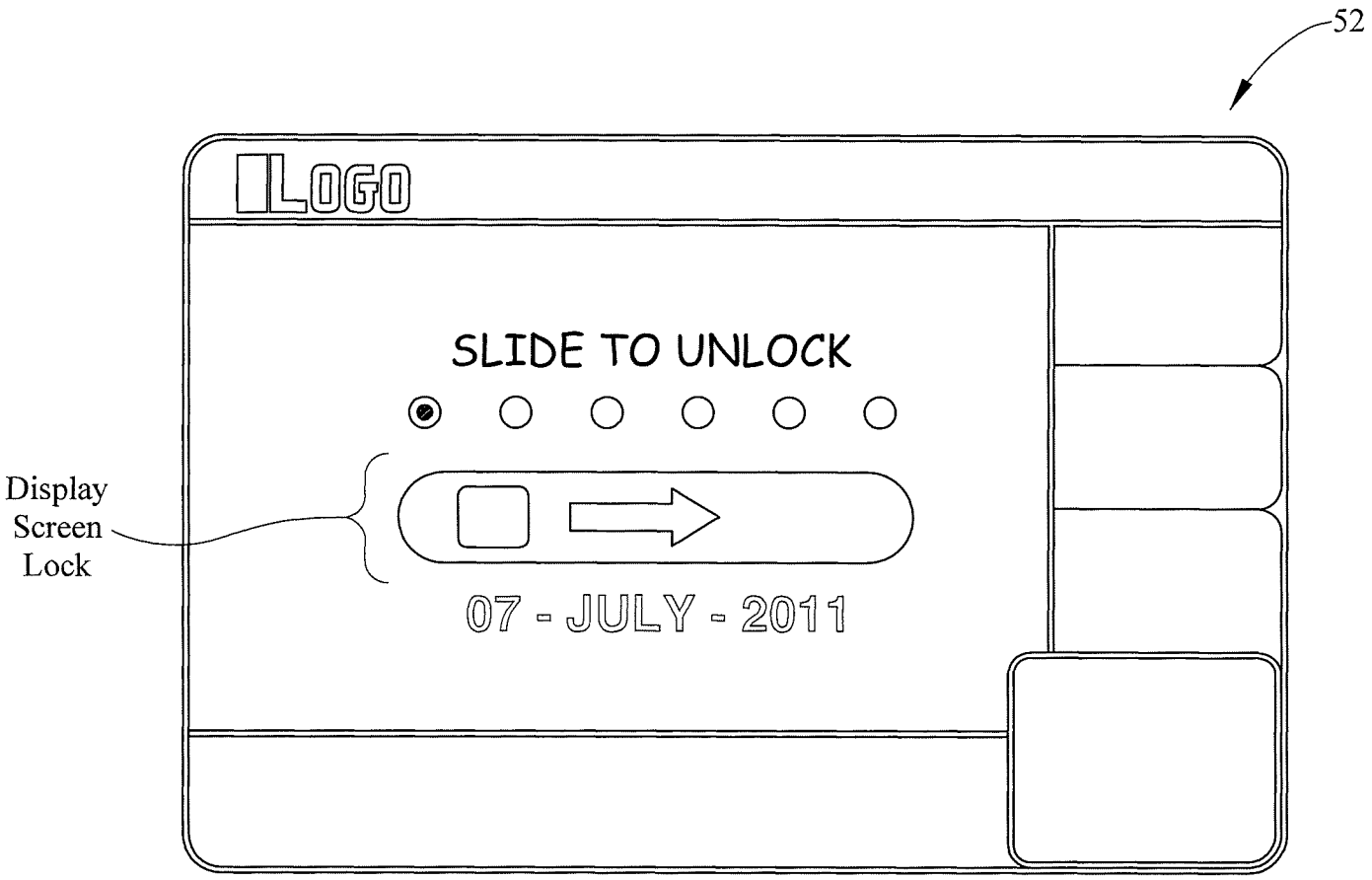
FIG. 19*a-k* show various contemplated configurations of the information and/or options displayed on the screen.
Figure 19B:
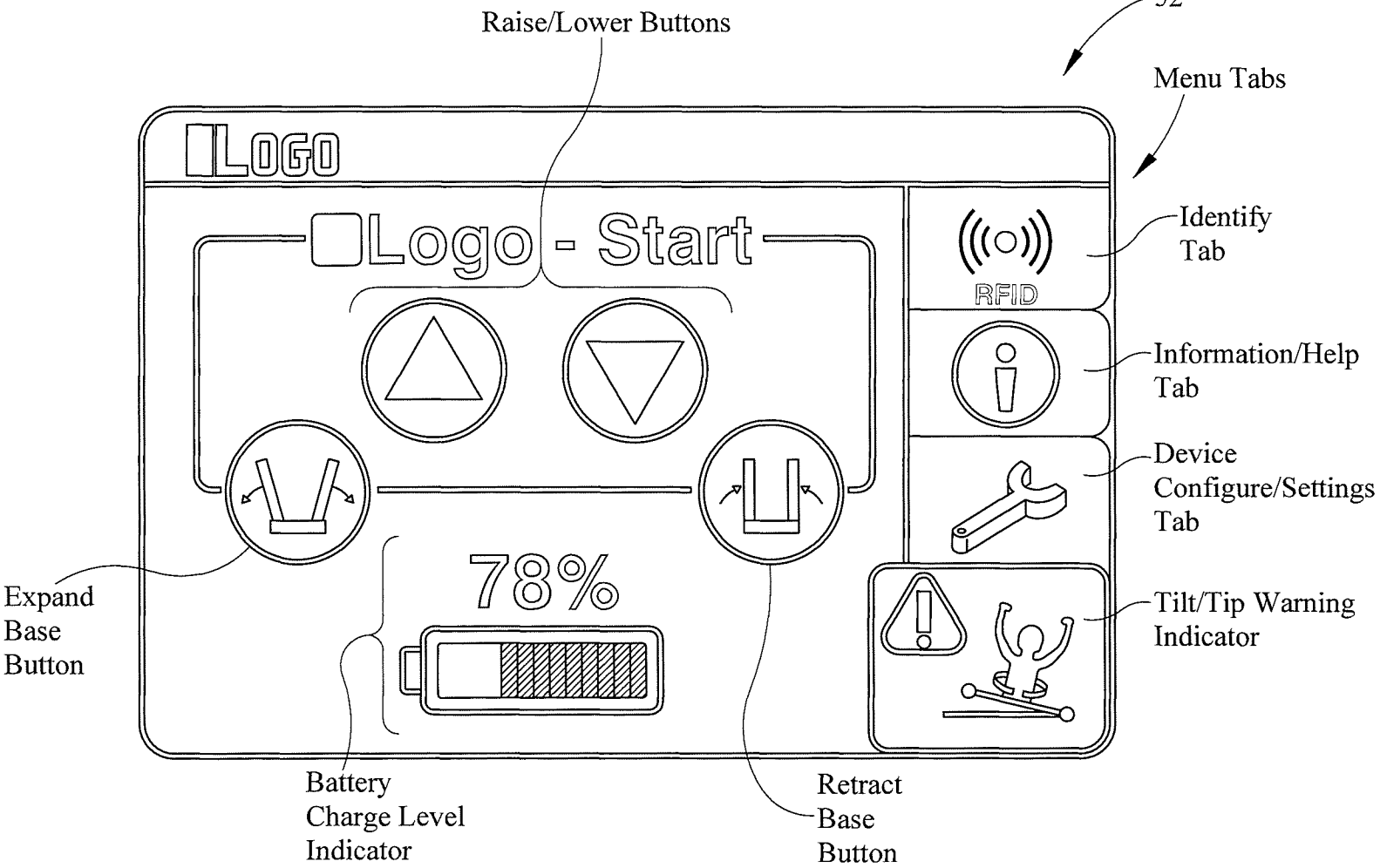
Figure 19C:
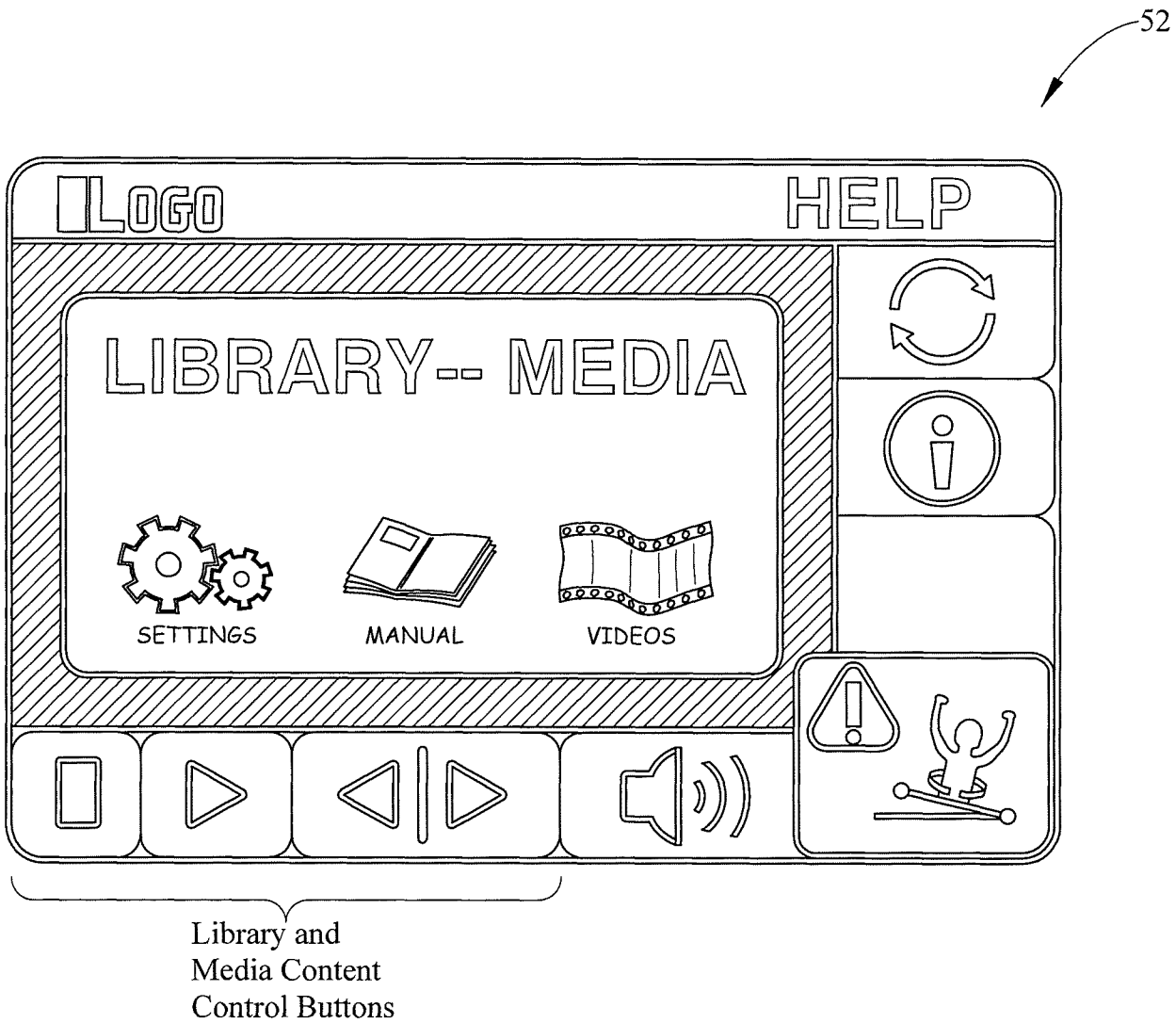
Figure 19D:
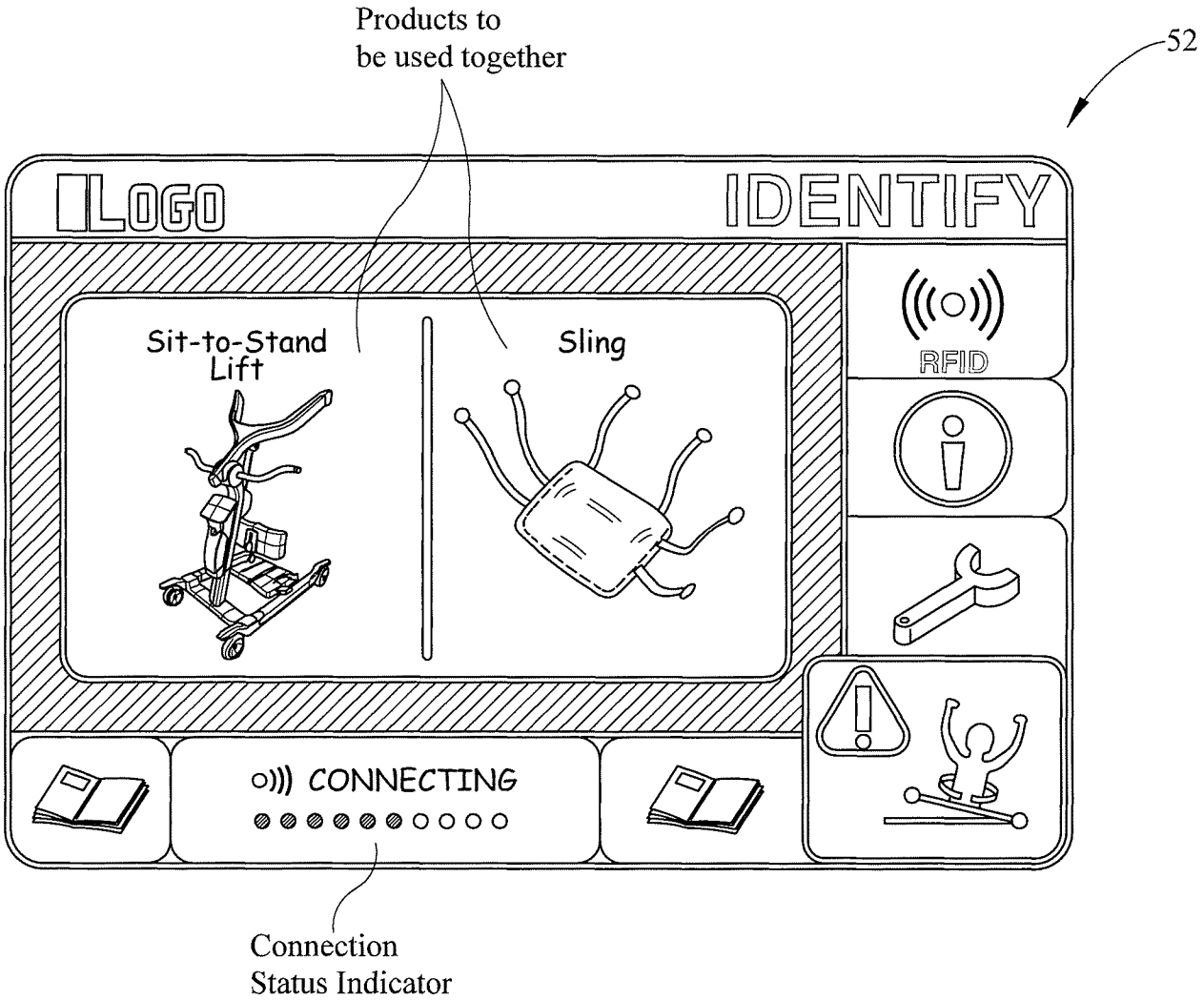

FIGS. 19*a-k* show various contemplated screen shots of the information and options displayed on the screen 52. In some contemplated embodiments, the screen 52 is a touch sensitive screen. In other contemplated embodiments, at least one button (not shown) is positioned adjacent to the screen 52 and is pressed by the user to select an option displayed on the screen 52. FIG. 19*a* shows the screen in a locked mode, according to one illustrative embodiment, to help prevent accidental or undesirable inputs from a user. The user drags their finger across the screen 52 in the direction of the arrow to unlock the screen 52 and to put the screen 52 in an operate mode where the user is able to provide inputs and receive outputs. In one illustrative embodiment, the user drags an icon across the screen in the direction of the arrow to unlock the screen 52. FIG. 19*b* shows the screen 52 in the operate mode, according to one illustrative embodiment, with raise and lower buttons, a battery charge indicator, base control buttons, a warning indicator, and various menu tabs including a configuration/settings tab, an information/help tab, and an identify tab. FIG. 19*c* shows the screen 52 displaying the help/information tab with a settings option that allows the user to change the settings for the sit-to-stand system, a user manual option that allows the user to read the manual for the sit-to-stand system, a video option that allows a user to play instructional videos, a volume control button, and library and media content control/navigation buttons that allow the user to play/stop videos and flip through manual pages. FIG. 19*d* shows the screen 52 displaying the identify tab with information about the sit-to-stand lift device and the sling used with the sit-to-stand lift device, and a connection status indicator configured to inform the user as to the status of the wireless connection between the sit-to-stand system and a hospital network, hospital bed, or other system. The connection can be wired and the sit-to stand lift device and sling can be associated with one another, a hospital bed, and/or a patient.

Figure 19E:
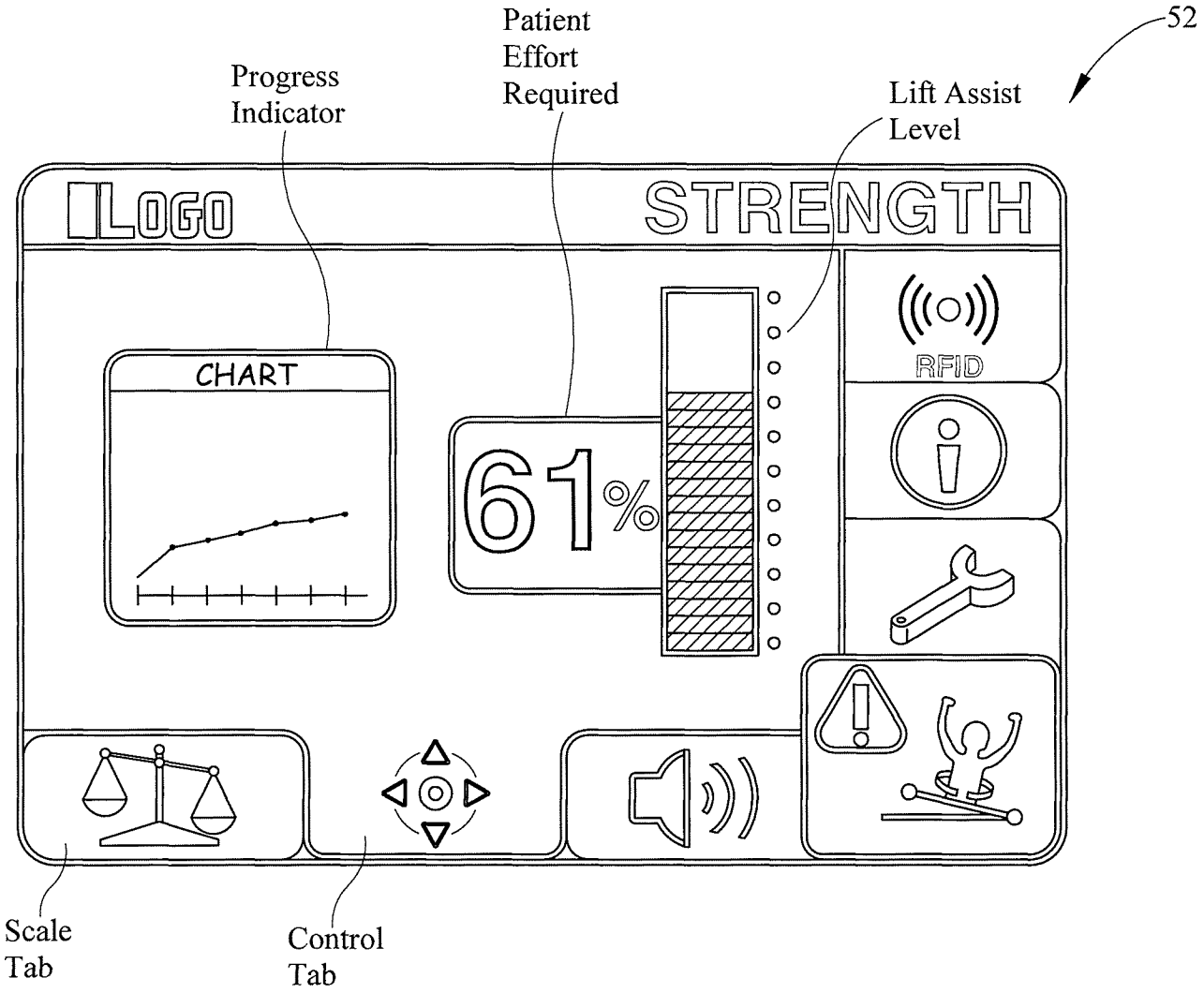
Figure 19F:
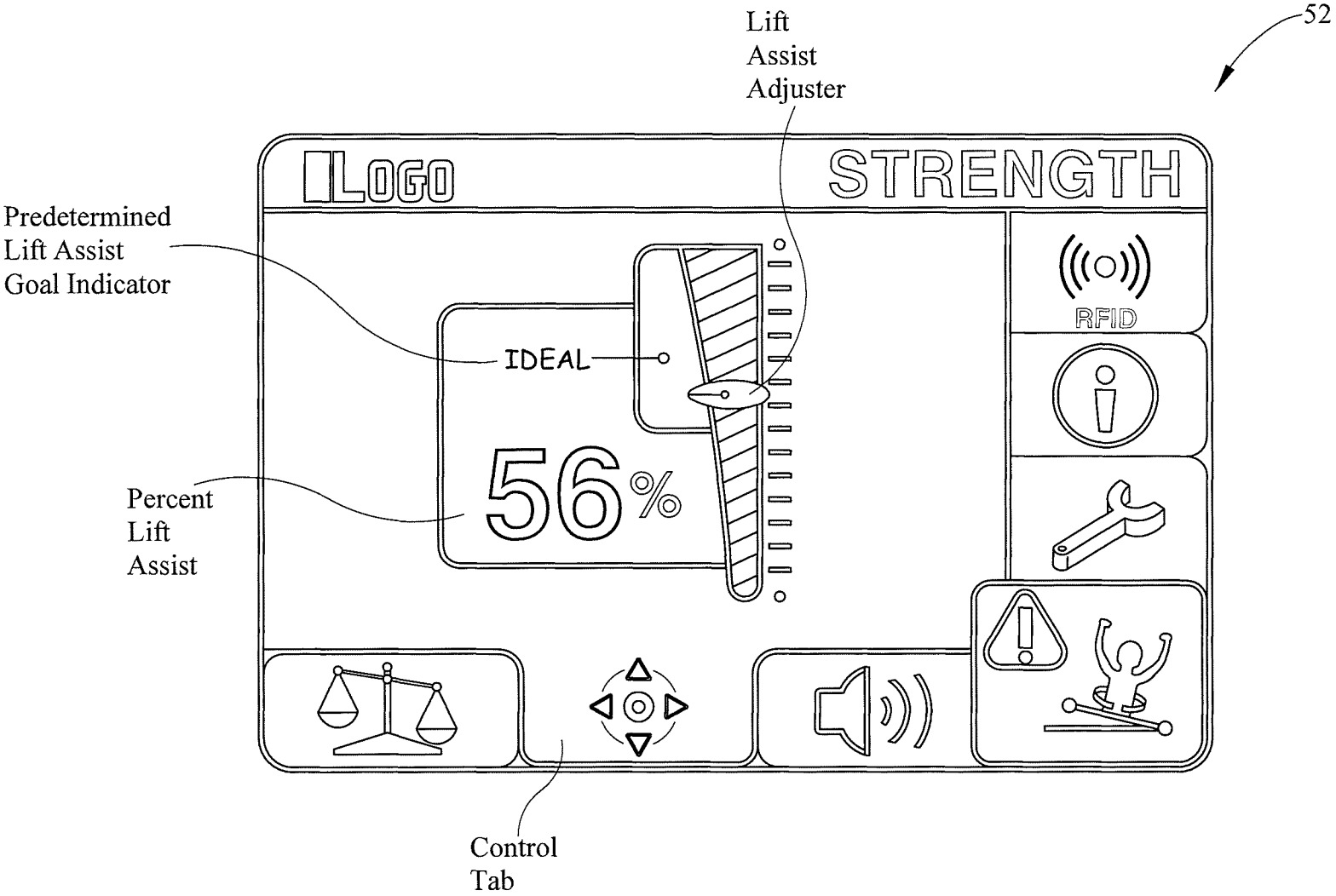
Figure 19G:
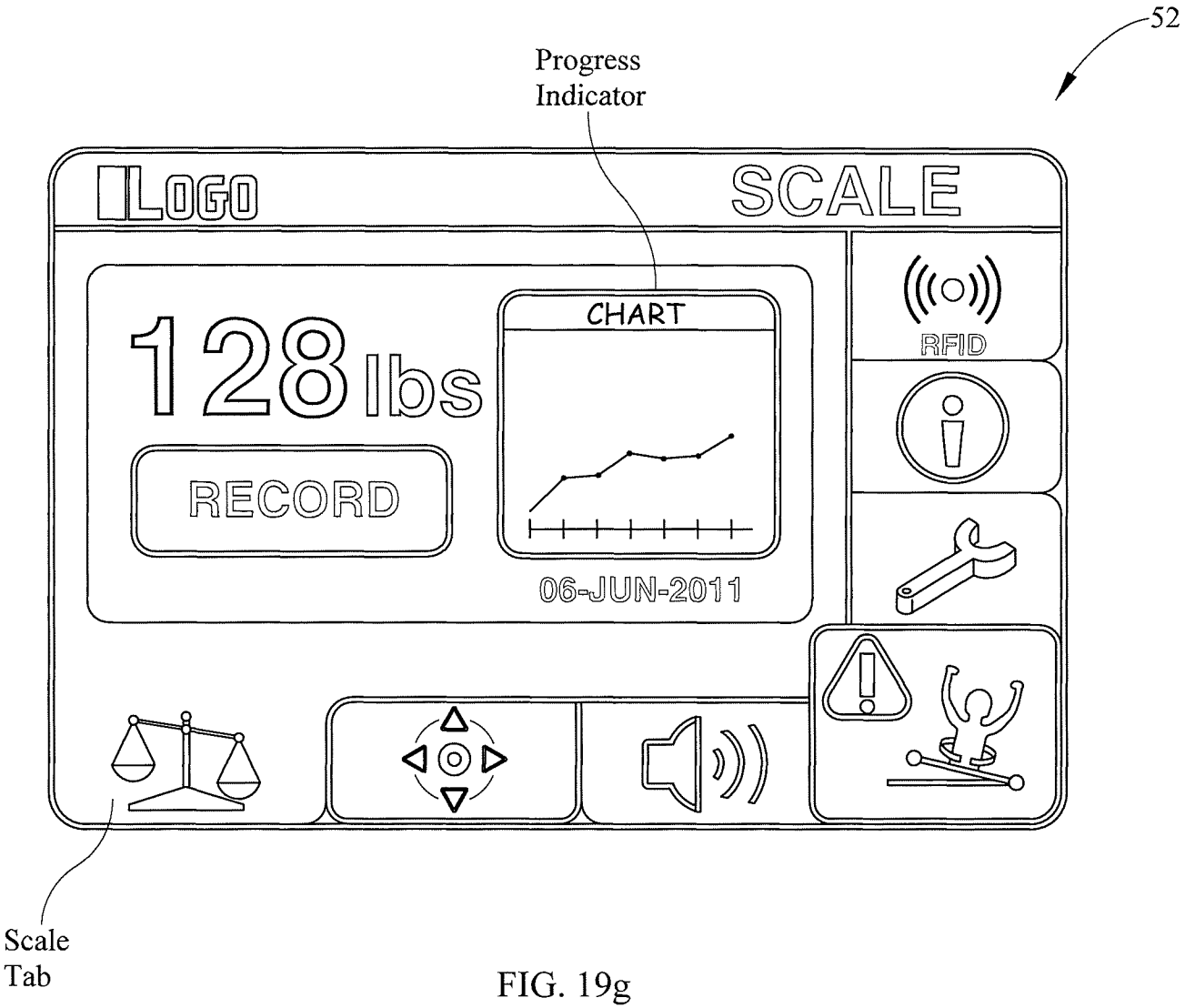
Figure 19H:
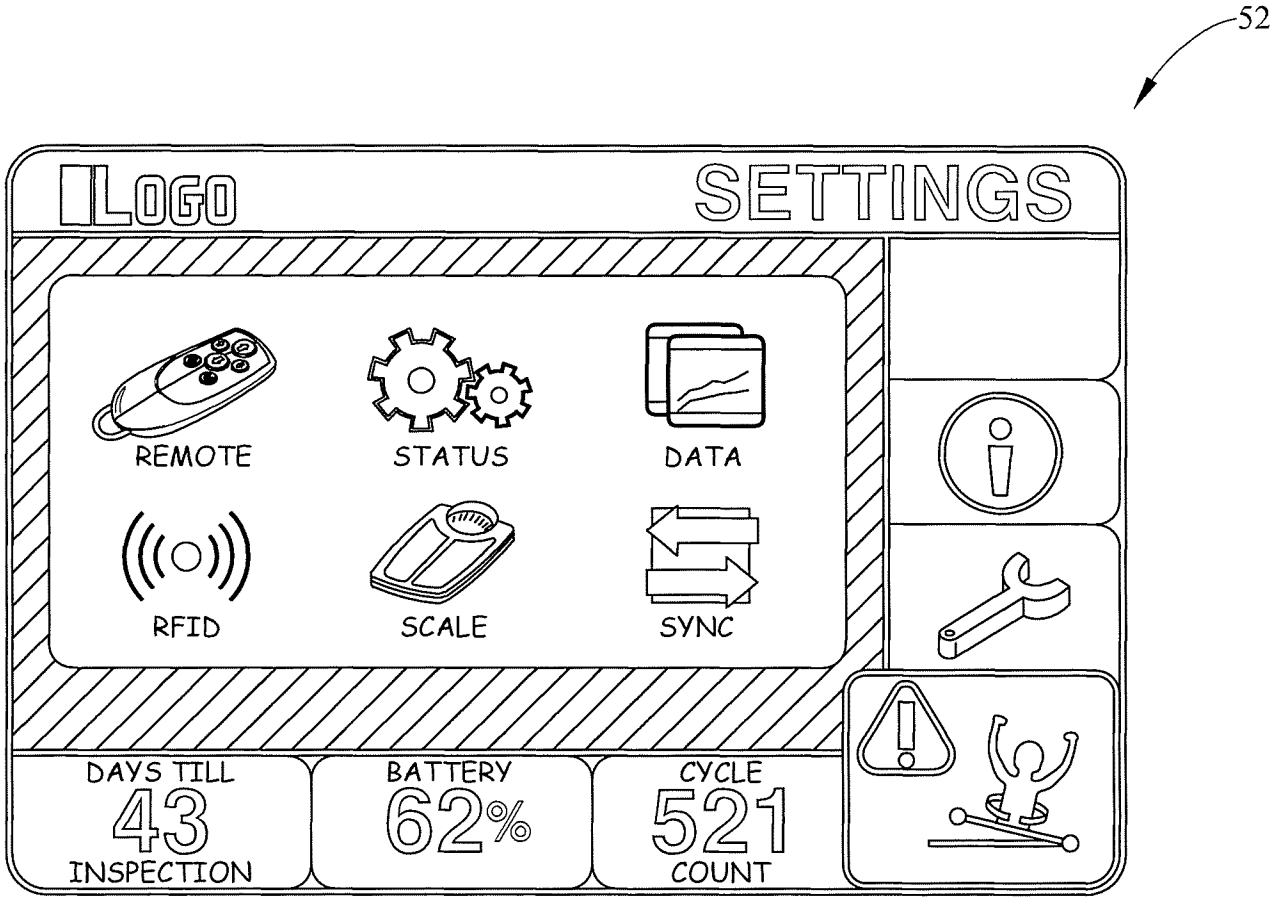
Figure 19I:
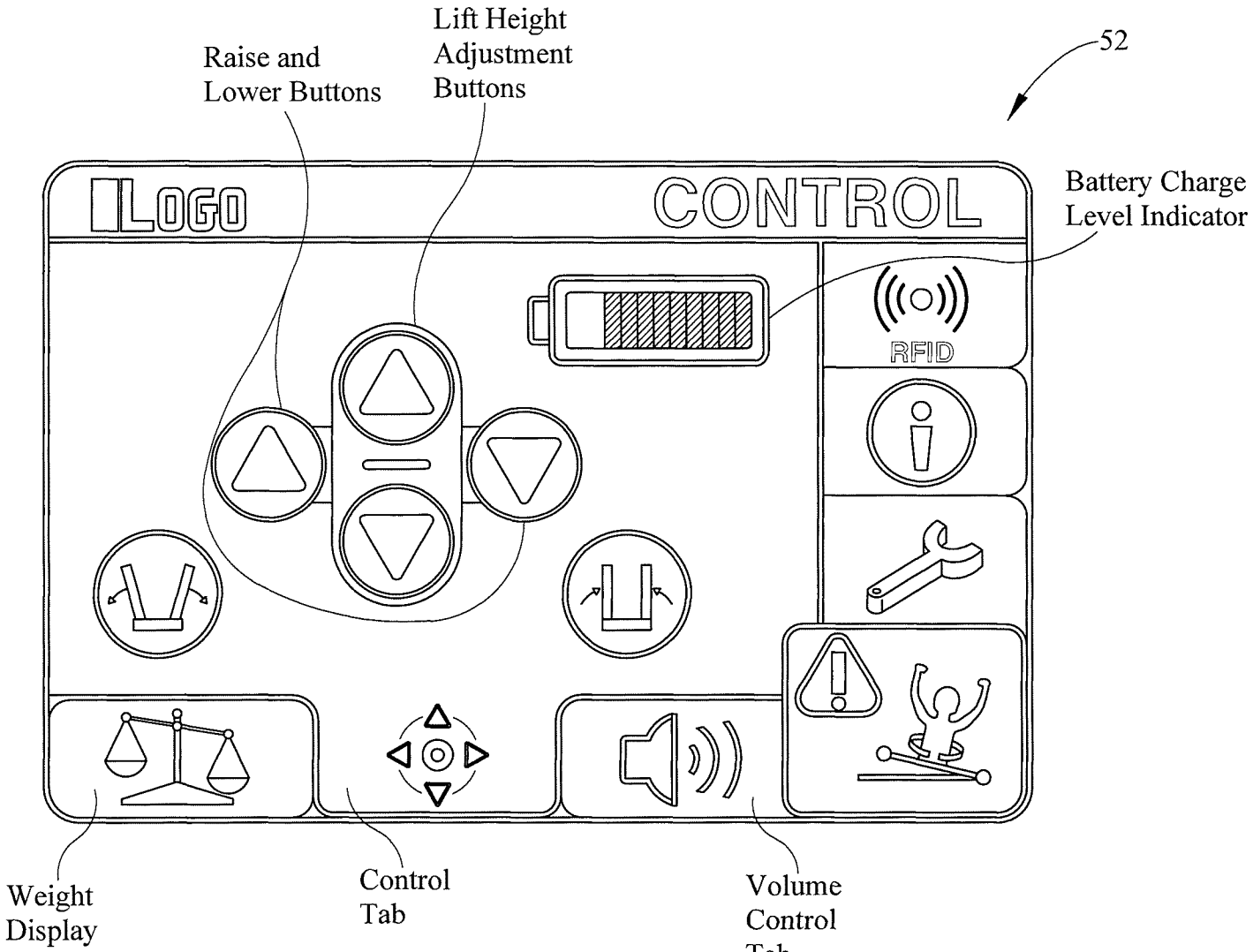
Figure 19J:
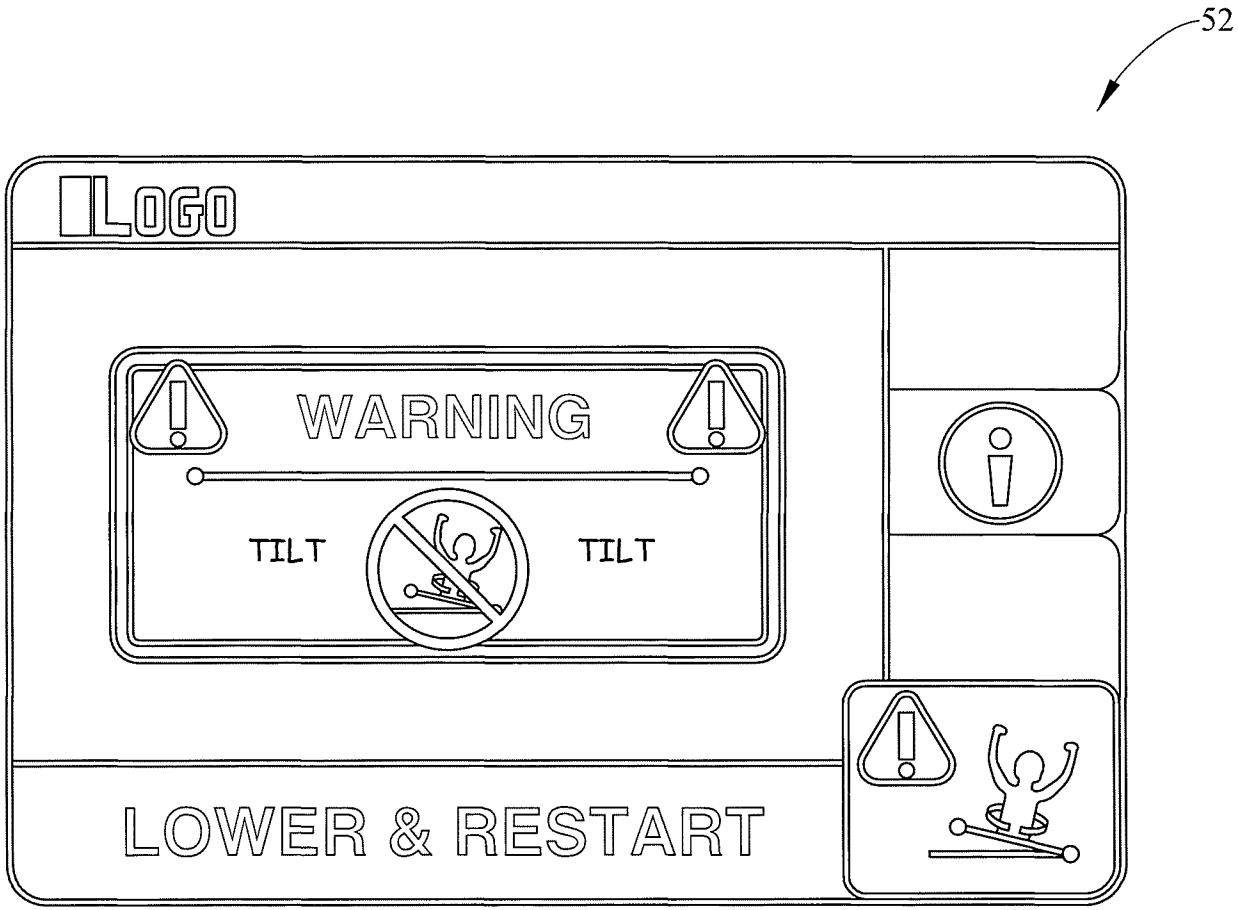
Figure 19K:
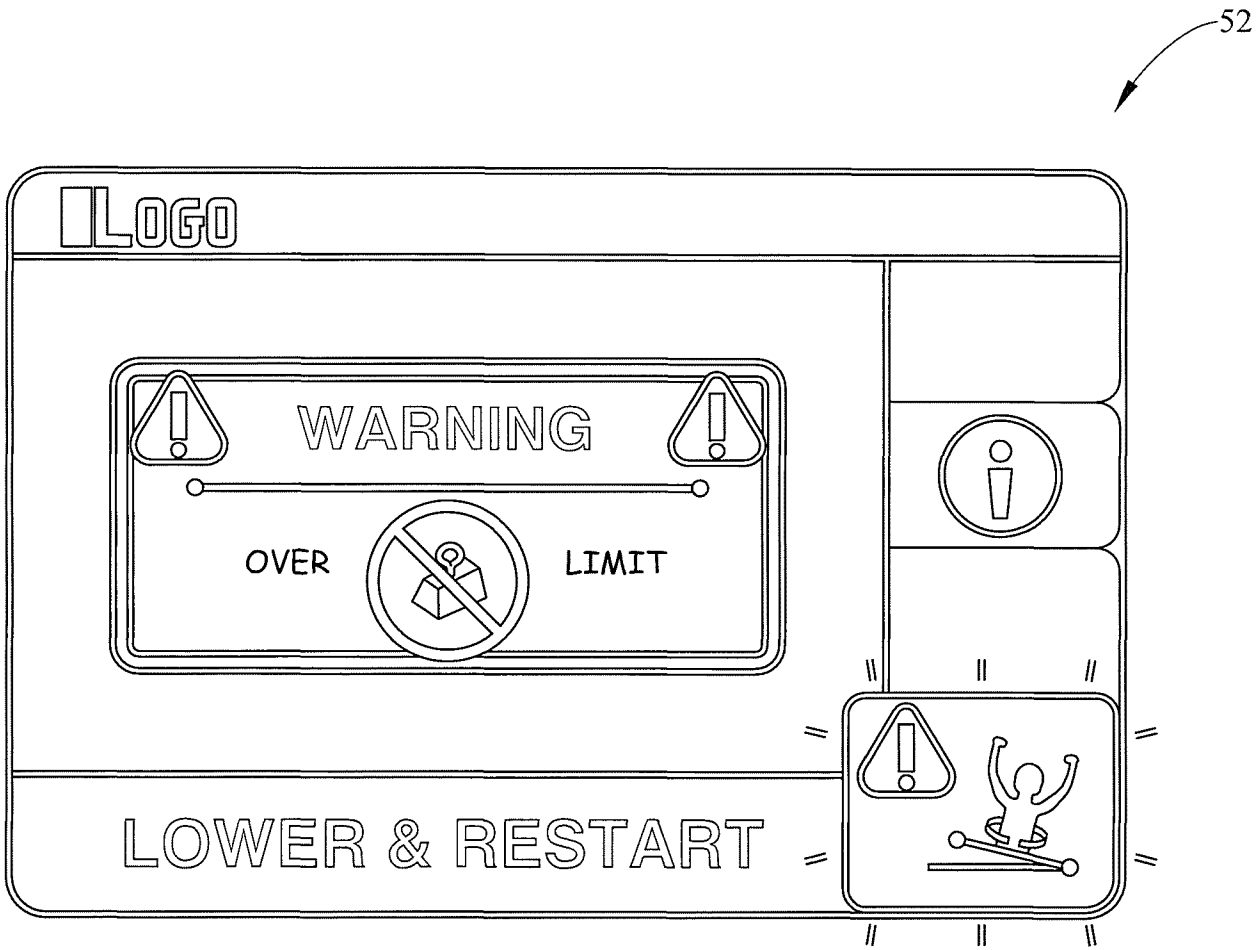

FIG. 19*e* shows the screen 52 in the operate mode according to another illustrative embodiment, where the screen 52 displays a control tab with a progress indicator showing the person's increased strength over time, an amount of effort the patient must put forth to stand up, and a level of assistance indicator showing how much the sit-to-stand lift will assist the person. FIG. 19*f* shows the screen 52 in the operate mode according to yet another illustrative embodiment, where the screen 52 displays a control tab with a level of assistance indicator showing how much the sit-to-stand lift will assist the person, a lift assist goal that indicates a desired ratio of patient effort and lift assistance, and a lift adjuster that can be moved along the vertical bar to change the amount of assistance provided by the sit-to-stand lift. FIG. 19*g* shows the screen 52 displaying the scale tab with the patient's weight and date, a record button configured to record the patient's weight and/or progress for the day, and a progress indicator graphing the person's improvement over time. The progress indicator could also show the decrease in lift assistance to indicate progress. FIG. 19*h* shows the screen 52 displaying the device configuration/settings tab with various options for configuring the sit-to-stand lift, a time until inspection indicator, a battery charge level indicator, and a counter that records the number of cycles the sit-to-stand lift has gone through. FIG. 19*i* shows the screen 52 displaying the control tab according to another illustrative embodiment with raise and lower buttons, height adjuster buttons configured to adjust the height of the lifting assembly based on the height of the patient, a battery charge indicator, base control buttons, and other features previously described with respect to FIGS. 19*b-h*. FIG. 19*j* shows a warning screen according to one illustrative embodiment used to alert a user and/or caregiver that the sit-to-stand system is beyond a predetermined tipping threshold. FIG. 19*k* shows a warning screen according to another illustrative embodiment used to alert a user and/or caregiver that the load being lifted by the sit-to-stand system is beyond a predetermined weight threshold.

Figure 6:
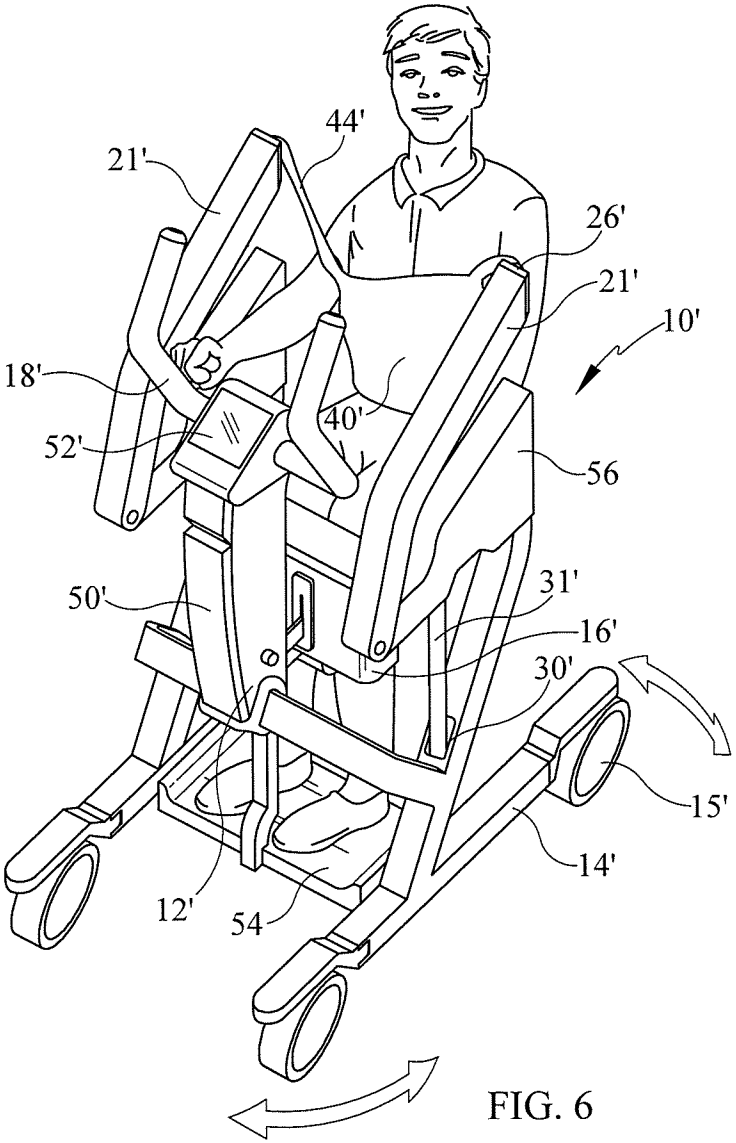
FIG. 6 is a perspective view of the embodiment of FIG. 5.
Figure 5:
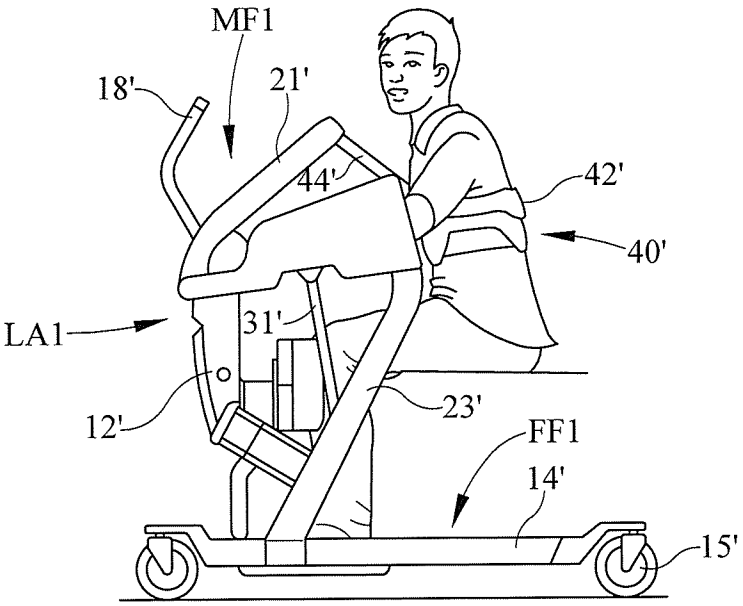
FIG. 5 is a side view of another embodiment, similar to FIG. 4 and configured and operating according to one or more inventive principles, showing the system in the lowered sitting position, and having the mechanics enclosed by a cover.

FIG. 5 is a side view of another embodiment showing the system in the lowered sitting position, and having the mechanics enclosed by a cover. Here the structure and function are like that of the embodiment of FIG. 4, except that the cross bars of the four bar mechanism are enclosed by a cover 56, the screen 52' extends separately upwardly from the pillar 12', and the electronics control box 50 includes an easily removable battery. FIG. 6 is a perspective view of the embodiment of FIG. 5.

Figure 7:
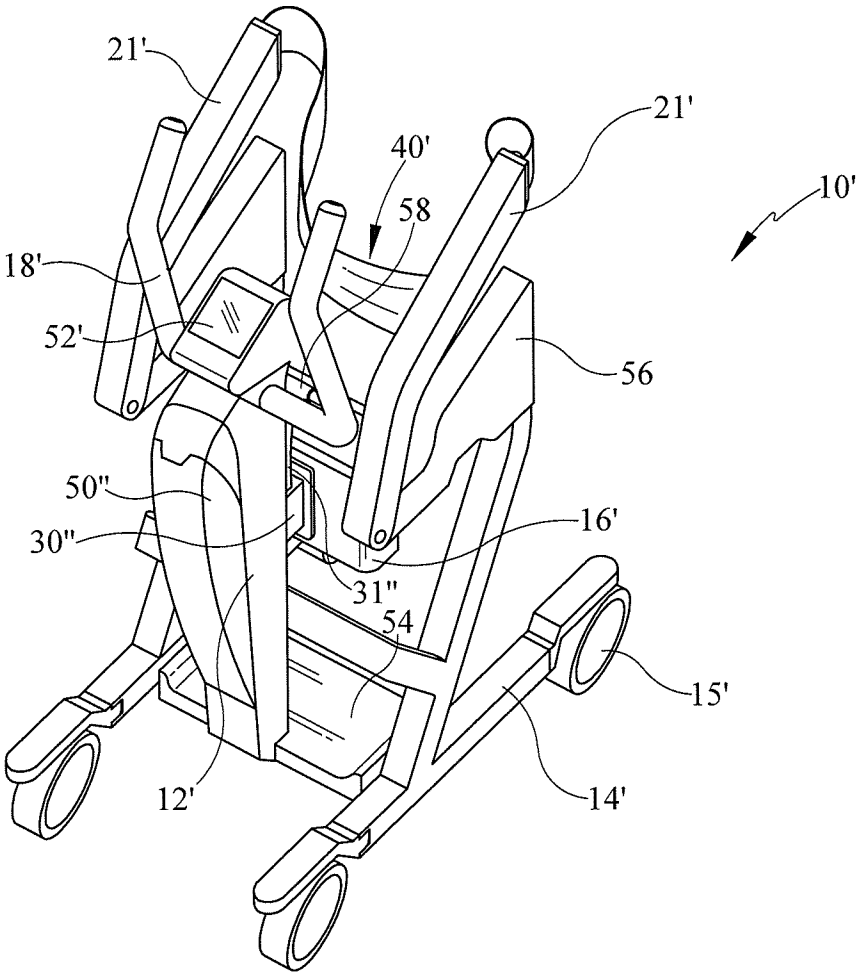
FIG. 7 is a perspective view of another embodiment, similar to that of FIG. 4, and configured and operating according to one or more inventive principles, having the mechanics enclosed by a cover and an adjustable screen, and using a single motor.

FIG. 7 is a perspective view of another embodiment with a few exceptions. Here, the control box 50" is external to the main pillar 12'. Further, the screen 52' is adjustable in nature, and can be tilted upwardly and downwardly around a pivot. In addition, the actuator 30" is a single, centrally mounted linear actuator, rather than an actuator on each side as in the prior figures. The actuator arm 31" pushes upwardly and downwardly, next to and generally parallel with the main pillar 12', and is pivotally connected to a cross arm 58 which moves both arms 21'.

Figure 8:
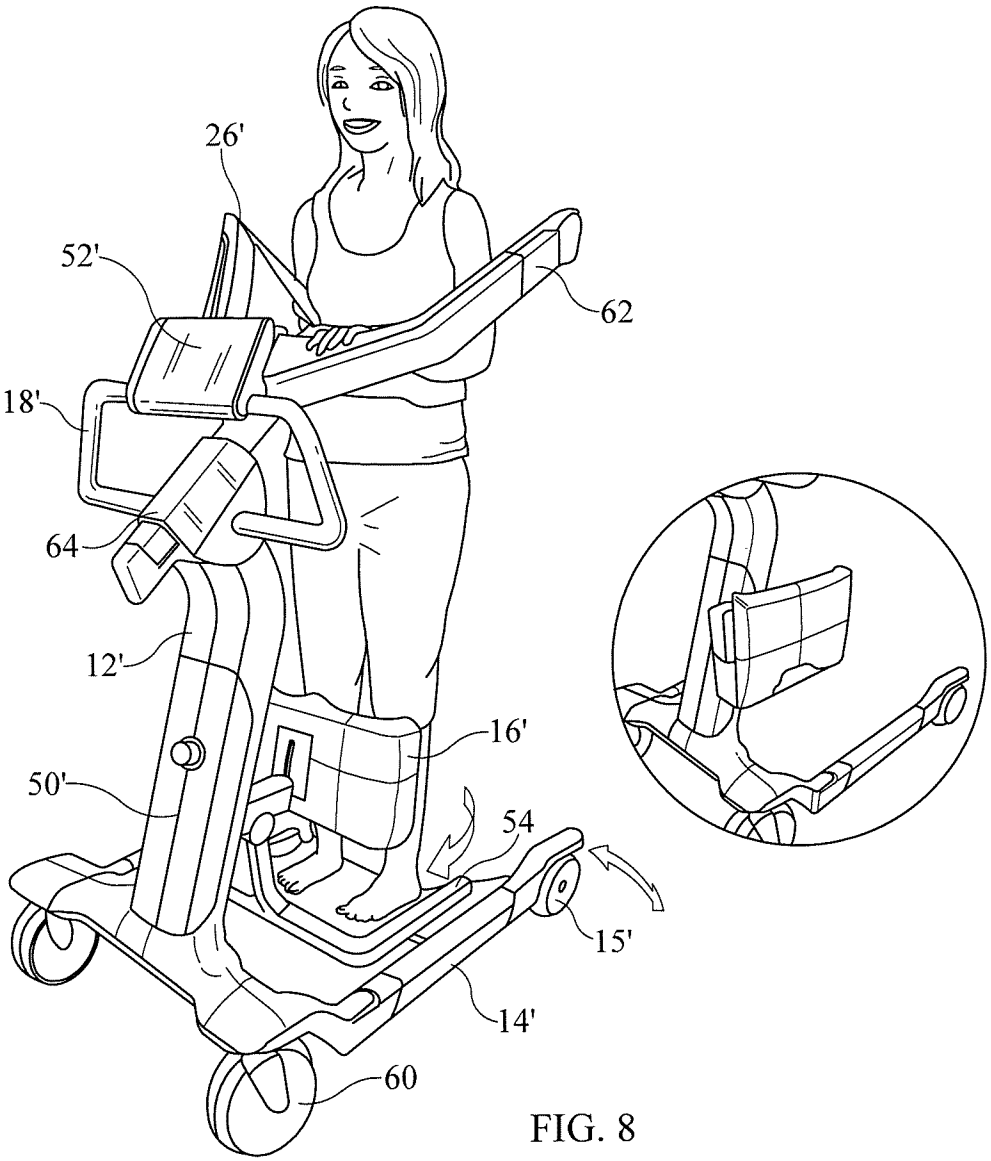
FIG. 8 is a perspective view of yet another embodiment, similar to that of FIG. 7, and configured and operating according to one or more inventive principles, but with a different mechanical system to carry out the motion.
Figure 9:
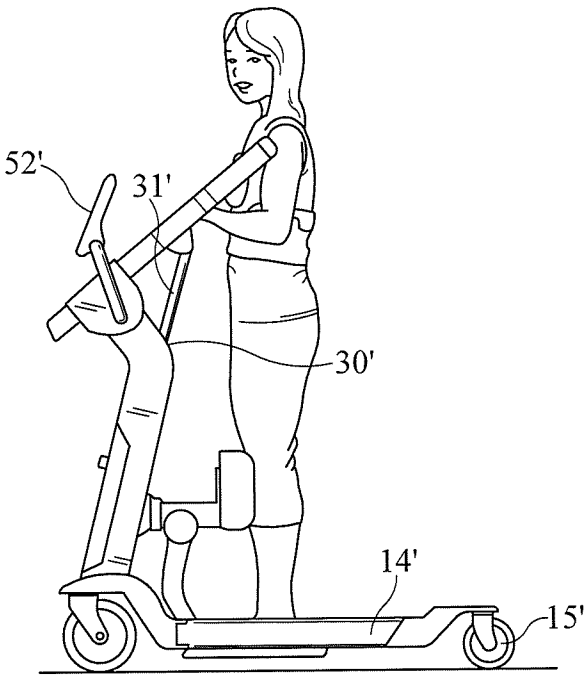
FIG. 9 is a side view of the embodiment of FIG. 8.

FIG. 8 is a perspective view of yet another embodiment with a different mechanical system to carry out the motion. FIG. 9 is a side view of the embodiment of FIG. 8. Here, the notable differences are in the wheels, the foot and shin supports, and in the mechanical motion system. In particular, the front wheels 60 are larger than the rear wheels 15'. The shin pad 16' and the foot support 54 are connected to the main pillar 12 via ball joints, allowing them both to be rotated out of the way when not needed, as best seen in FIG. 8. In addition, the actuation is carried out by a generally Y shaped member 62 which translates in sleeve 64, which is rotatable about the pillar 12', such as via a pillar joint. Accordingly, the motor 30' actuates the arm 31' which moves the arm 62 causing it to both rotate and translate related to the fixed pillar 12'. This creates a motion similar to that described above with respect to the other embodiments. The patient's torso is first moved generally forward and over the thighs and knees, and then upward to a standing position.

Figure 10:
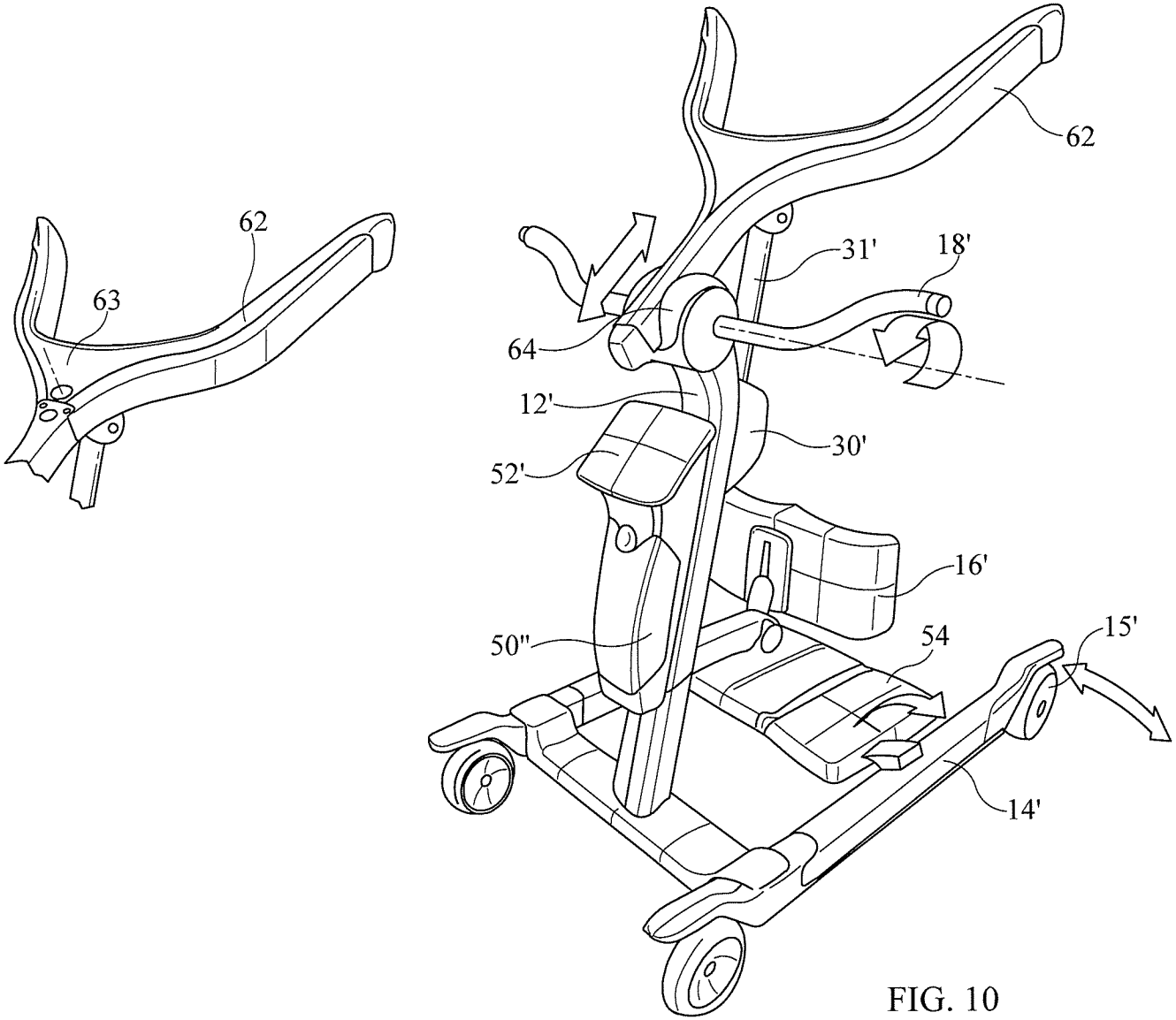
FIG. 10 is a perspective view of another embodiment, similar to that of FIGS. 8-9, but with some differences in the controls, footpad, wheels, and arms.
Figure 12:
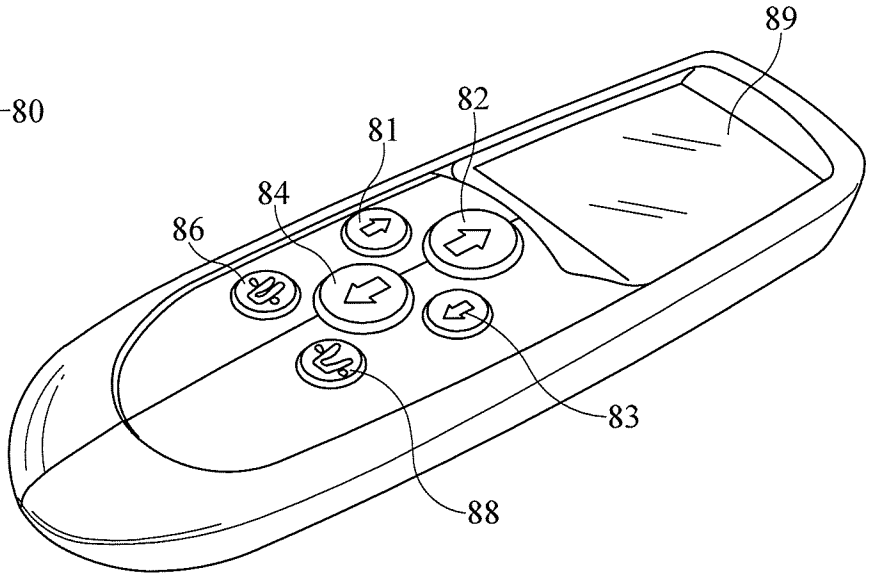
FIGS. 11-14 are embodiments of pendants or hand control devices that can control patient lifting devices, such as those examples described in FIGS. 1-10.
Figure 11:
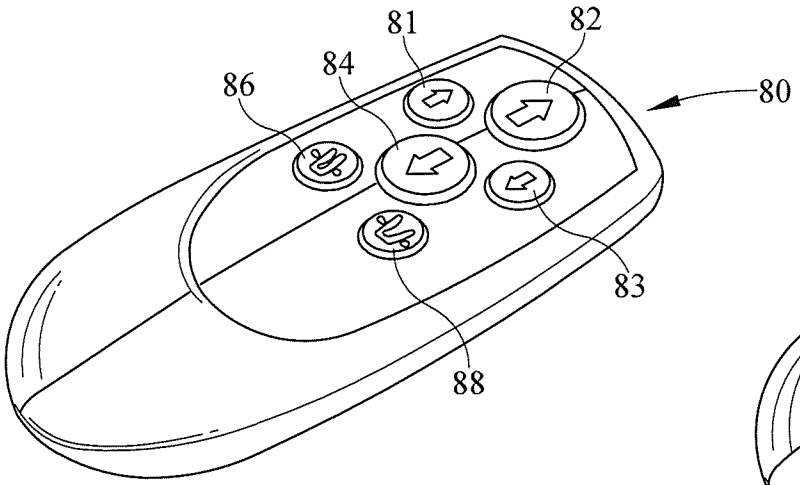
Figure 14:
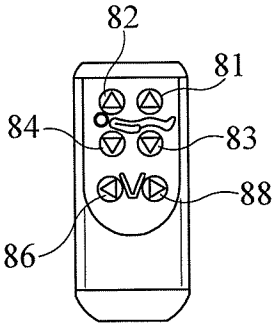
Figure 13:
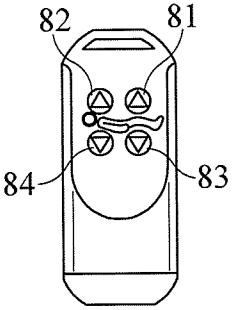

FIG. 10 is a perspective view of another embodiment, similar to that of FIGS. 8-9. In this example, the screen 52' is fixed rather than adjustable, the control box 50" is external rather than integrated with the pillar 12', and the foot pad 54 rotates about the lower frame feet 14, rather than about the pillar. Also, the wheels 15' are all one size, and the handles 18' are open and extend to the sides rather than closed. Also, the arms of the Y shaped (e.g., wishbone or extended U shaped) member 62 are pivotable to a more open or more closed position, via a pivot connection 63.

Figure 15:
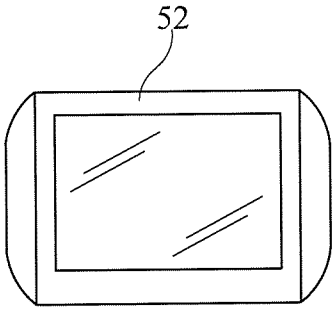
FIG. 15 is an embodiment of a screen that can control and/or provide feedback regarding a patient lifting device, such as those examples described in FIGS. 1-10 and 16-17.

FIGS. 11-14 are embodiments of pendants or hand control devices that can control patient lifting devices, such as those described above in FIGS. 1-10. Here, buttons 82 and 84 control the up and down (sit and stand) motions of the actuator. The buttons 81 and 83 control actuators which can control the position of the shin pad, if so equipped. The buttons 86 and 88 control how far the arms on both sides are moved inwardly or outwardly. A screen 89 is provided in the example of FIG. 12 to allow for instructions and feedback regarding the device being controlled. As can be understood, not all buttons are necessary, depending on how the device is equipped; and if a touch screen is used then fewer or no buttons may be needed. FIG. 15 is an example of screen 52 described above.

Figure 16:
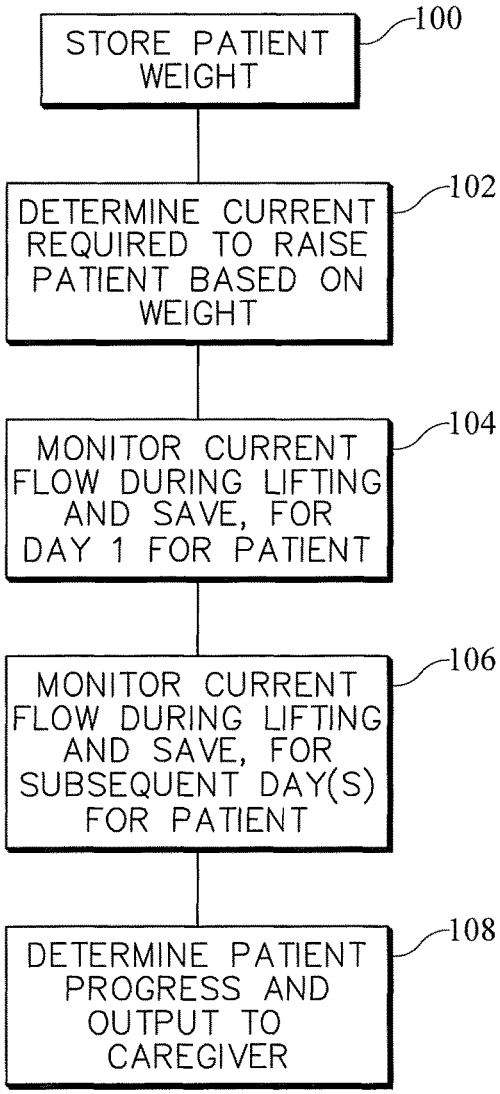
FIG. 16 is a flow diagram illustrating an embodiment of a method for monitoring patient strength and strength change using a patient lifting device, which operates according to one or more inventive principles.

FIG. 16 is a flow diagram illustrating an embodiment of a method for monitoring patient strength and strength progress using a patient lifting device, which operates according to one or more inventive principles. In this embodiment, the patient weight is stored, at function block 100. In some embodiments, the patient weight is entered via a user interface. In some embodiments, the patient weight is measured by force sensors, such as, load cells, coupled to the lifting device, such as, in the lower frame 14 by the wheels 15, the arms, or other locations. In some contemplated embodiments, the patient weight is received from an electronic medical record (EMR). In some embodiments, the patient weight is measured on a person support structure, such as, a hospital bed, mattress, a stretcher, chair, or other support structures, and communicated from the person support structure to the lifting device.

Then, based on the patient weight, it is determined what electric current is expected to be required to raise the patient, as shown at block 102. This can be carried out by a look up table which is established to correlate patient weight with the actuator current for the lifting device (e.g., a sit-to-stand device). Alternatively, an equation can be utilized. When the patient is actually lifted in use, using the device, the current flow of the actuator is monitored as shown at block 104, such as, by using a current sensor. This operation can be carried out at multiple times, such as, during a lifting of the patient on a first day, and during the lifting of the patient on a second day, as shown at block 106. Based on the actual current required, the strength of the patient can be determined, as shown at block 108. Again, this can be carried out by a lookup table or equation correlating actual current to expected current. For example, if 10 amps would be required to lift the patient using actuator 30, based on the patient's weight, but only 5 amps was utilized on day 1, then it could be determined that the patient has 50% leg strength for standing. If, on day 10, only 2.5 amps were needed, then it is known that on day 10 the patient has 75% leg strength for standing and that the patient has increased their leg strength by 50% in ten days. These statistics can be output to the user, such as, via screen 52. Accordingly, FIG. 16 is one example of how patient strength and/or change in strength can be measured and tracked based upon actual and expected lifting force.

Figure 20:
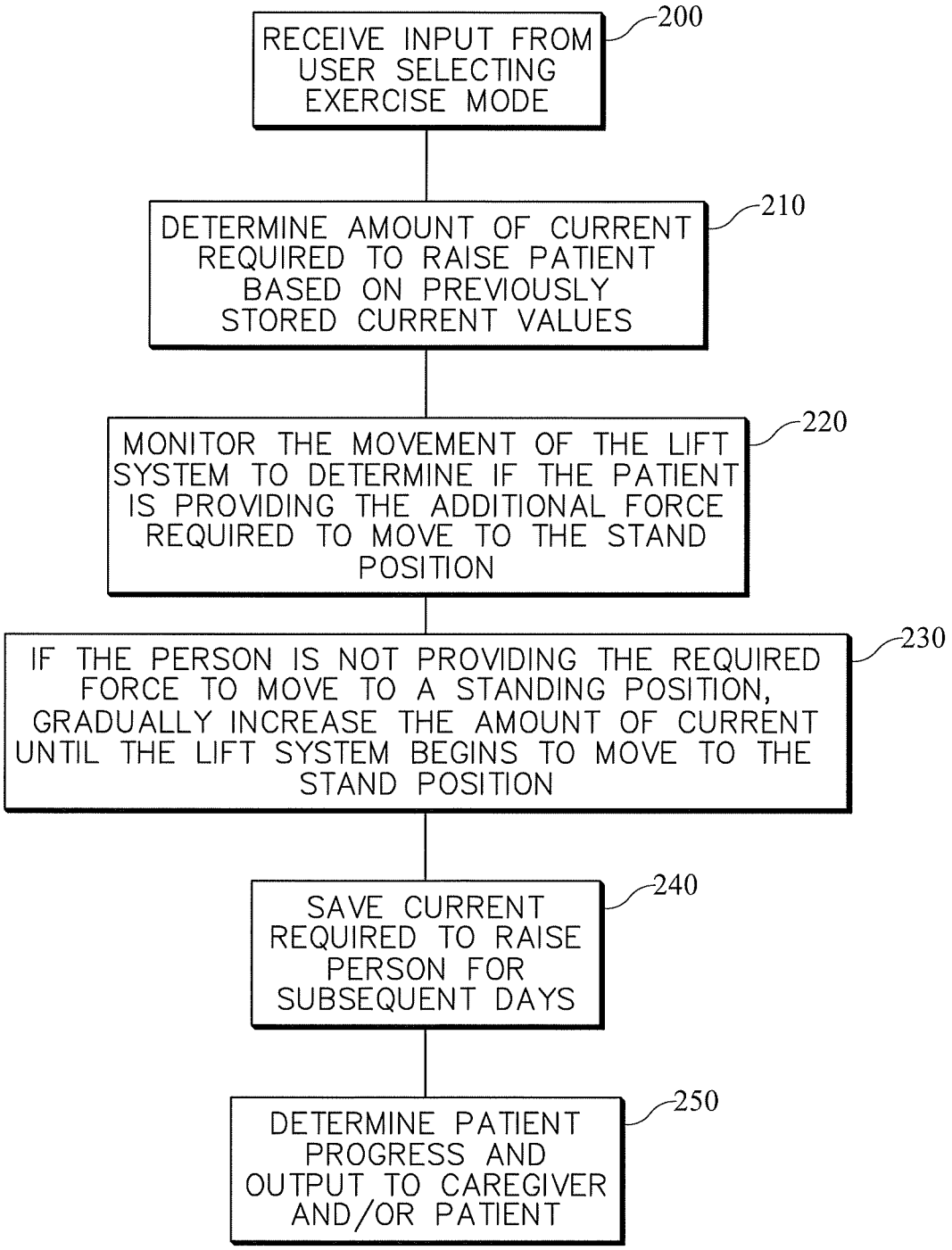
FIG. 20 is a flow diagram illustrating an embodiment of a method for reducing the amount of assistance provided by the sit-to-stand system based on the person's history of use of the sit-to-stand system, which operates according to one or more inventive principles.

In some embodiments, the system is be configured to reduce and/or increase the amount of assistance provided to the patient in order to help exercise the patient and increase the patient's strength as shown in FIG. 20. In one contemplated embodiment, the electronics system 151 includes a processor 155 and memory 153 electrically coupled to the processor 155 and storing procedures. The procedures include instructions that, when executed by the processor 155, cause the control system 151 to control the actuator controller 150 to control the operation of the lift in accordance with the instructions. In one contemplated embodiment, the procedure includes a number of steps beginning in step 200 with the user selecting an exercise mode that is configured to gradually reduce the assistance provided by the lift to help increase the strength of the person using the lift. In some contemplated embodiments, the patient lifting system can alert the patient that the lifting system is in the exercise mode and what will be required of the patient in order for them to move from the sitting position to the standing position. In step 210, the amount of assistance needed to lift the patient from a sitting position to a standing position is determined. The amount of assistance needed is based on the change in assistance required by the lift system over time. In some contemplated embodiments, the previous amount of assistance required to move the person can be calculated as a function of the person's weight and the operational characteristics of the actuator (i.e., the amount of electrical current required to lift various loads), or can be found in a look-up table as previously discussed. In some contemplated embodiments, the increase and/or decrease in assistance from the lifting system is based on the patient's change in strength over time, an input from the patient or caregiver, and/or a pre-programmed exercise/therapy schedule. In some contemplated embodiments, the amount of assistance needed can be determined as a function of the change in the amount of energy used by the lifting system.

In some contemplated embodiments, the amount of assistance needed can be determined as a function of the change in the electrical current used by the actuator. In some contemplated embodiments, the amount of assistance needed can be determined as a function of the change in weight supported by the lifting system. In one example, the lift system is required to provide 90% of the assistance the first week the patient uses the lift and 80% assistance the second week. In step 220, the movement of the lift system is monitored to see if the patient is providing the additional force required to move between the sitting and standing positions. In step 230, if the patient is unable to lift themselves with the reduced assistance, the system can gradually increase the assistance until the patient is able to stand. In step 240, the amount of assistance required to lift the patient is saved. In some contemplated embodiments, the amount of effort exerted by the person can be saved, the current used by the actuators can be saved, the amount of energy used by the lifting system can be saved, and the amount of force the lifting system supports can be saved. In step 250, the patient's progress is calculated and sent to the caregiver and/or patient. In some contemplated embodiments, the procedures described in this paragraph can be used in other person lifts, such as, overhead lifts coupled to the ceiling of a room, such as, the Likorall 242 ES sold by Liko.

Figure 17:
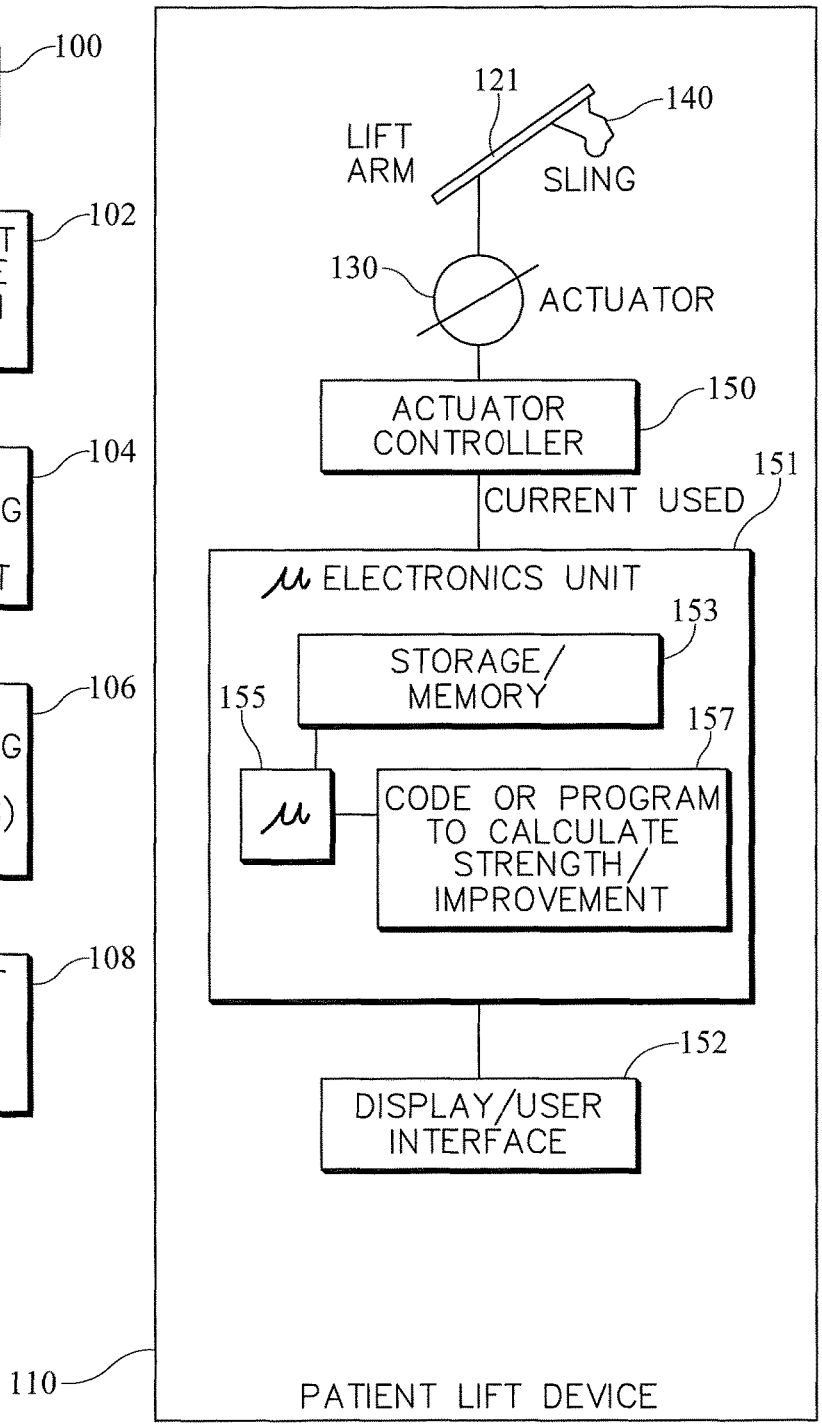
FIG. 17 is a block diagram illustrating the configuration of a patient lifting device, which is configured and operates according to one or more inventive principles.

FIG. 17 is a block diagram illustrating the configuration of a patient lifting device, which is configured and operates according to one or more inventive principles. Here, the device 110 includes an actuator 130 that moves a lift arm 121 that moves a sling 140. An actuator controller 150 provides feedback on the current used by the actuator 130 and provides it to electronics unit 151, which can be integrated with or separate from the actuator controller 150. The electronics unit 151 includes a microprocessor 155 that accesses memory 153 where the current and lookup tables can be stored. A program 157 can also be stored in the memory 153, or can be stored separately. The program or code 157 carries out the method of FIG. 16 and displays the patient's strength and/or improvement in strength on the user interface 152 (e.g., screen). Such a system can be included in one or more of the embodiments of FIGS. 1-10 above, or in other embodiments.

Figure 18:
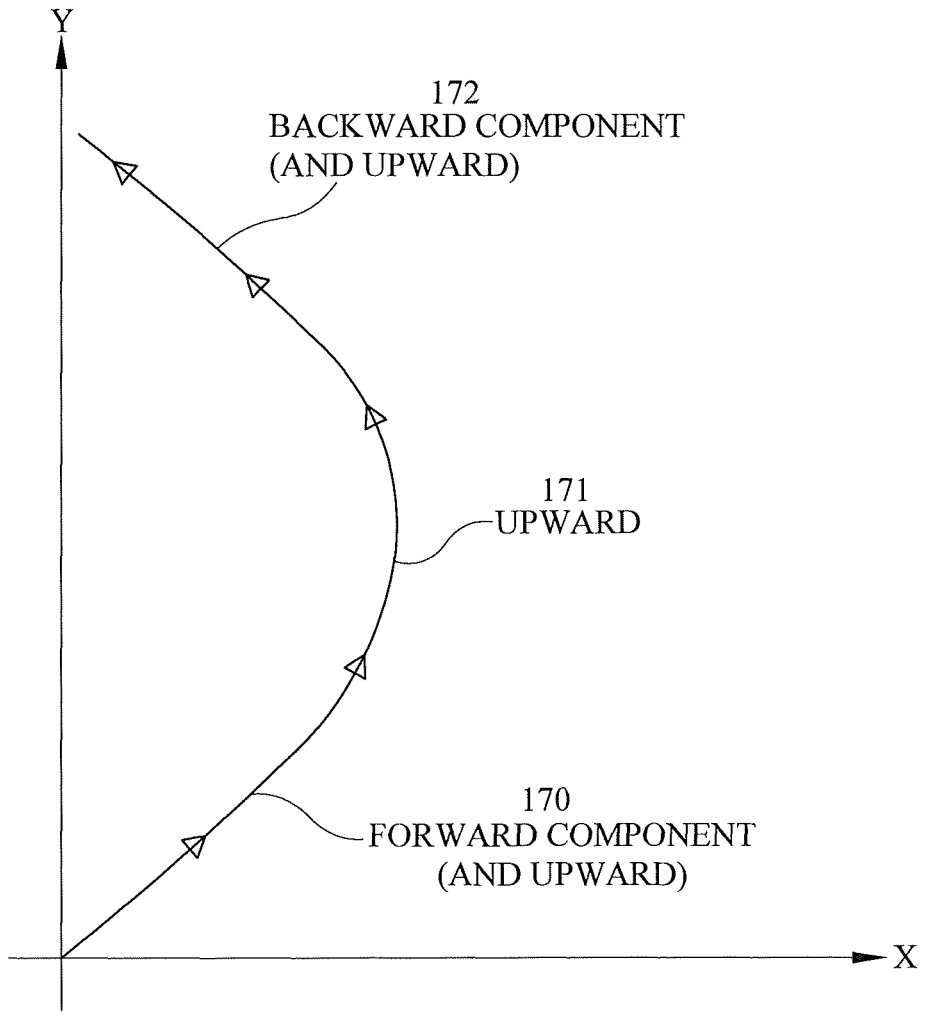
FIG. 18 is a curve showing movement of a patient sling support by a patient lifting device, according to one more inventive principles.

FIG. 18 is a curve showing movement of a patient sling support by a patient lifting device, according to one more inventive principles. Here the x axis represents how far the support moves toward the main pillar of the sit-to-stand device, and the y axis represents how far the support moves upwardly from the floor. As can be seen here, the motion involves an initial movement 170 that has relatively equal upward and forward movements, an intermediate motion 171 that has almost all upward motion, and a final motion 172 that has both a backward component and an upward component. Such a motion can be carried out by one or more of the embodiments described above in FIGS. 1-10, or by other embodiments.

Many other embodiments of the current disclosure are envisioned. One embodiment is a patient sit-to-stand device which moves the patient through an improved sequence of movements. In one embodiment, a sit-to-stand device moves the patient's torso forward first, such that the torso is generally tilted forward and over the thighs. The device then lifts the patient.

In another embodiment, a patient lifting device includes an electronics unit which carries out a method or algorithm to determine the patient's strength and/or the improvement in the patient's strength. The method comprises determining patient progress and/or strength based on the energy required to lift the patient, and/or the expected energy required to lift the patient using patient weight.

According to one embodiment, a method is provided for assisting a patient and is carried out by a device. The method comprises moving the device in a way which is adapted to move the patient's torso generally over the thighs and tilted forward while the patient is in a seated position. The method further comprises simultaneously or subsequently moving the device in a way which is adapted to raise the patient's torso generally upwardly toward a generally standing position.

In some embodiments, movement can be achieved by moving arm members which are adapted to cause movement of a patient sling (e.g., a belt, harness, or fabric support). The movement in some embodiments can comprise simultaneously moving an arm member rotationally relative to a fixed frame member and moving the arm slidingly within a slot or aperture. Some embodiments can further comprise moving or placing the patient's thighs toward the front of the device such that the knees are generally over or in front of the patient's feet to place the patient in the initial seated position.

In another embodiment, a system is provided for assisting a patient and comprises a sling or belt, a fixed frame, a lift arm, and an actuator. The sling is adapted to go around the back of a patient and comprises straps adapted to go under the patient's arms. The lift arm is supported by the frame and is movable in a nonlinear manner relative to the fixed frame and includes a support for supporting the sling. The actuator is adapted to move the arm. Initial movement of the arm by the actuator causes the patient's torso to be initially moved forward and generally over the thighs while the patient is in an initial sitting position. Further movement of the arm causes the patient to be pulled upwardly to a standing position.

In some embodiments, the arm comprises multiple segments and multiple pivot points and a sling support (e.g., a recess). The arm movement is adapted to cause the sling support to initially move in a direction having a forward component during the initial movement and then move in a direction having a backward component during the further movement.

In some embodiments, the frame includes a base frame having wheels, a leg support pad, and pair of handles. In some embodiments, the arm comprises a pair of arms moved by the actuator.

In another embodiment, a system is provided for assisting a patient, comprising a fixed frame, an actuator supported by the fixed frame, and an arm coupled with the frame and movable by the actuator. The arm comprises multiple segments and multiple pivot points and a sling support. The arm and actuator are configured to cause the sling support to initially move in a direction having a forward component and then to move in a direction having a backward component. The arm and actuator are also configured to move the sling support in a direction having an upward component. In some embodiments, the frame includes a base frame having wheels, a leg support pad, and pair of handles configured to be grasped by a user when standing.

In yet another embodiment, a system is provided for assisting a patient and comprises a lower frame, an actuator, and a four bar mechanism above the lower frame and configured to be moved by the actuator. The four bar mechanism has a sling support, wherein movement of the four bar mechanism by the actuator causes the sling support to be moved forwardly and upwardly.

In some embodiments initial upward movement of a four bar mechanism, when in a lowered state for the seated position, causes forward movement of the sling support. Later upward movement of the four bar mechanism, when in the raised state for the standing position, causes backward movement of the sling support. In some embodiments, initial movement of a four bar mechanism causes a movement of the sling support having a forward component and later movement of the four bar mechanism causes a movement of the sling support having a backward component.

According to another embodiment, a system is provided for assisting a patient. The system comprises a fixed frame and a moving member movable relative to the fixed frame. The fixed frame has a main pillar and attachment points for the ends of a strap of a patient sling. The moving member is movable relative to the fixed frame and has receptacles to receive the strap of the patient sling and to allow the straps to slide along the receptacles. The moving member is rotatable relative to the fixed frame to cause the sling to move upwardly and inwardly relative to the pillar.

In one embodiment, a system is provided for assisting a patient, and comprises a fixed frame having an aperture and an arm supported by the frame. The arm is supported by the frame and is simultaneously rotatable relative to the fixed frame and slides within the aperture. The arm includes supports such as hooks adapted to hold a patient support sling or belt.

Still other embodiments can include any one or more of the following features, alone or in any combination: 1) a system configured to move the torso forward while the patient is in a seated position such that the torso is generally tilted forward and over the thighs, and to then lift the patient to the standing position; 2) a four bar mechanism which creates an initial movement which causes forward movement of the sling support, and later movement which causes backward movement of the sling support; 3) a sit-to-stand lift arm which moves rotationally while simultaneously allowing the lift arm to slide within a slot; 4) a sling which has straps which goes under the arms of the patient and around the back of the patient and is pulled by a lift arm which moves in a nonlinear manner to pull the patient's torso forward first and then upward; 5) a sit-to-stand lift arm system which comprises multiple segments and multiple pivot points and is configured to cause the sling support to initially move in a direction having a forward component and then to move in a direction having a backward component; 6) a four bar mechanism for a sit-to-stand system which is moved by an actuator to cause a sling support to be moved forwardly and upwardly; 7) a system having a fixed frame with fixed attachment points for a sling and a moving member movable relative to the fixed frame and having sliding attachment points for the sling to cause the sling to move upwardly and inwardly; 8) a system having a fixed frame and an arm which has a patient sling support and is simultaneously rotatable relative to the fixed frame and slides within an aperture of the fixed frame; 9) a device and method for determining patient strength by using the actual force (e.g., via an electrical parameter, such as, an electrical current) required to lift the patient using a lifting device and the expected force required to lift the patient (as indicated by patient weight); 10) a device and method for determining improvement in patient strength by using the actual force required to lift the patient using a lifting device at two different times; 11) a device and method for varying the amount of assistance a lifting device provides to a person moving between a standing position and a sitting position based on the person's strength; 12) a device and method for at least one of increasing and decreasing the amount of assistance a lifting device provides to a person moving between a standing position and a sitting position as a function of the person's rehabilitation progress; 13) a device and method for increasing the amount of effort a person must exert to move with a lifting device between a standing position and a sitting position as a function of the person's increased strength over time; and/or 14) a device and method for displaying at least one of a person's increased strength over time, an amount of assistance the lifting device will provide, and an amount of effort the person is required to exert to move from a sitting position to a standing position.

Although certain illustrative embodiments have been described in detail above, many other embodiments, variations, and modifications are possible that are still within the spirit and scope of this disclosure as described herein and as described in the following claims. For example, while force is measured using electric current above, other parameters such as voltage, energy, pressure or direct force measurement could be utilized in other embodiments. Moreover, any feature or aspect described above in any given embodiment could be used alone or in combination with any other feature or aspect of any other embodiment.

We claim:

1. A system for assisting a person, comprising:

a frame;

a guide rotatably coupled to the frame at a first joint, the guide including a slot there through;

an actuator rotatably coupled to the frame at a second joint;

a lift arm rotatably coupled to the actuator at a third joint and a free end of the lift arm being movable within the slot, the lift and being configured to cause the guide to rotate about the first joint with respect to the frame as the actuator moves the lift arm between a first position and a second position with respect to the frame; and a sling configured to engage a person and assist the person in moving between a seated position and a standing position as the lift arm moves between the first position and the second position, wherein the actuator is coupled to the lift arm between the guide and the sling.

2. The system of claim 1, wherein the sling is configured to engage a torso of the person.

3. The system of claim 1, wherein the sling is coupled to the frame and slidably engages the lift arm.

4. The system of claim 1, wherein the sling is coupled to the lift arm.

5. The system of claim 1, wherein the lift arm is Y-shaped with a first end as a base of the Y and a second and a third end as a top of the Y, the first end being movable within the slot and the second and the third end being coupled to the sling.

6. The system of claim 1, wherein movement of the lift arm from the first position to the second position over a first range of motion causes the person to move from the seated position to a first intermediate position where the person is seated and the person's torso is generally positioned over the person's thighs, wherein, during the first range of motion, the person's torso is moved toward a reference plane passing through the frame.

7. The system of claim 6, wherein movement of the lift arm from the first position to the second position over a second range of motion causes the person to move from the first intermediate position to a second intermediate position, wherein, during the second range of motion, the person's torso is moved generally upwardly and toward the reference plane.

8. The system of claim 7, wherein movement of the lift arm from the first position to the second position over a third range of motion causes the person to move from the second intermediate position to the standing position, wherein, during the third range of motion, the person's torso is moved generally upwardly and away from the reference plane.

9. The system of claim 1, wherein movement of the lift arm from the first position to the second position causes the person's shoulders to move along a generally concave, elliptical path.

10. The system of claim 1 further comprising a leg support pad coupled to the frame.

11. The system of claim 1 further comprising a plurality of wheels coupled to the frame.

12. The system of claim 1 further comprising a handle coupled to the frame and configured to be gripped by the person.

13. A system for assisting a patient, comprising:

a sling adapted to go around the back of a patient and comprising straps adapted to go under a patient's arms;

a frame;

a lift arm supported by the frame and which is movable relative to the frame and includes a portion for supporting the sling;

an actuator to move the lift arm, wherein initial movement of the lift arm by the actuator causes the patient's torso to initially move forward and generally over the thighs while the patient is in an initial sitting position, and wherein further movement of the lift arm causes the patient to be pulled upwardly to a standing position; and a controller configured to control the actuator as a function of a change in weight supported by the lifting system, wherein the weight supported by the lifting system changes over time based on the patient's strength.

14. The system of claim 13, further comprising a display device communicatively coupled to the controller, wherein the display device displays the amount of assistance provided to assist the patient in moving to the standing position.

15. The system of claim 14, wherein the display device is touch sensitive and the amount of assistance the actuator will provide is adjustable by moving an icon display by the display device along a predetermined path.

16. The System of claim 13, further comprising:

a guide rotatably coupled to the frame at a first joint, the guide including a slot there through, wherein:

the actuator is rotatably coupled to the frame at a second joint;

the lift arm is rotatably coupled to the actuator at a third joint and a free end of the lift and is movable within the slot, the lift arm being configured to cause the guide to rotate about the first joint with respect to the frame as the actuator moves the lift arm between a first position and a second position with respect to the frame.

17. A system for assisting a person, comprising:

a frame;

a lift member movably coupled to the frame;

a sling coupled to the lift member and configured to engage a person;

an actuating device coupled to the frame and the lift member, the actuating device being configured to move the lift member with respect to the frame to move a person engaged by the sling from a first position to a second position;

a sensor configured to sense at least one characteristic of the actuating device; and a controller electrically coupled to the sensor and configured to determine an amount of strength of the person engaged by the actuating device as a function of the at least one characteristic of the actuating device as the person is moved from the first position to the second position.

18. The system of claim 17, further comprising a display device communicatively coupled to the controller, wherein the display device displays an amount of assistance provided to assist the person in moving to a standing position.

19. The system of claim 18, wherein the display device is touch sensitive and the amount of assistance the actuating device will provide is adjustable by moving an icon display by the display device along a predetermined path.

* * * * *